US008746357B2

(12) United States Patent
Butz et al.

(10) Patent No.: US 8,746,357 B2
(45) Date of Patent: Jun. 10, 2014

(54) FINE WATER MIST MULTIPLE ORIENTATION DISCHARGE FIRE EXTINGUISHER

(75) Inventors: James R. Butz, Lakewood, CO (US); Craig S. Turchi, Lakewood, CO (US); Amanda Kimball, Lakewood, CO (US); Thomas McKinnon, Boulder, CO (US); Edward P. Riedel, Boulder, CO (US)

(73) Assignees: ADA Technologies, Inc., Littleton, CO (US); Colorado School of Mines, Golden, CO (US)

( * ) Notice: Subject to any disclaimer, the term of this patent is extended or adjusted under 35 U.S.C. 154(b) by 449 days.

(21) Appl. No.: 11/875,494

(22) Filed: Oct. 19, 2007

(65) Prior Publication Data

US 2008/0128145 A1 Jun. 5, 2008

Related U.S. Application Data

(60) Provisional application No. 60/862,383, filed on Oct. 20, 2006, provisional application No. 60/887,518, filed on Jan. 31, 2007.

(51) Int. Cl.
*A62C 2/00* (2006.01)

(52) U.S. Cl.
USPC ..... 169/46; 169/45

(58) Field of Classification Search
CPC ..... A62C 31/00
USPC ..... 169/46, 30, 71, 73, 44, 45; 239/303, 239/327, 328, 398, 407, 408; 222/402.1, 222/386.5
See application file for complete search history.

(56) References Cited

U.S. PATENT DOCUMENTS

| | | | |
|---|---|---|---|
| 2,164,153 | A | 6/1939 | Friedrich |
| 2,884,075 | A | 4/1959 | Poon |
| 3,045,761 | A | 7/1962 | Ciarlo |
| 3,428,131 | A | 2/1969 | Winslow |
| 3,486,539 | A | 12/1969 | Jacuzzi |
| 3,620,299 | A | 11/1971 | Wiseman, Jr. |
| 3,692,118 | A | 9/1972 | Yao |
| 3,876,147 | A | 4/1975 | Aris |
| 3,938,708 | A | 2/1976 | Burger |
| 3,979,061 | A | 9/1976 | Kircher |
| 4,038,875 | A | 8/1977 | Walkotten |
| 4,091,876 | A | 5/1978 | Valdatta |

(Continued)

FOREIGN PATENT DOCUMENTS

| | | |
|---|---|---|
| EP | 0 155 583 A1 | 3/1985 |
| EP | 1 488 829 A1 | 12/2004 |
| WO | WO 02/078788 | 10/2002 |

OTHER PUBLICATIONS

Beswick Engineering: 10-32 THD or Barb—CKV, http://www.beswick.com/products/product_detais.php?pid=2302, downloaded Oct. 16, 2007 (3 pages).

(Continued)

*Primary Examiner* — Davis Hwu
(74) *Attorney, Agent, or Firm* — Sheridan Ross P.C.

(57) ABSTRACT

The present invention is directed to a suppression system in which a carrier gas and suppression liquid are contained in a common containment vessel and separated by a separation member. The separation is one or more of movable, deformable, or shape changing in response to pressure exerted by the stored gas.

37 Claims, 16 Drawing Sheets

(56) References Cited

U.S. PATENT DOCUMENTS

| | | | | |
|---|---|---|---|---|
| 4,231,430 | A | 11/1980 | Byun | |
| 4,268,460 | A | 5/1981 | Boiarski et al. | |
| 4,382,884 | A | 5/1983 | Rohringer et al. | |
| 4,427,074 | A | 1/1984 | Wollin | |
| 4,436,101 | A | 3/1984 | Seatts | |
| 4,458,945 | A | 7/1984 | Ayler et al. | |
| 4,531,588 | A * | 7/1985 | Brunsicke | 169/9 |
| 4,560,007 | A | 12/1985 | Molloy et al. | |
| 4,578,102 | A | 3/1986 | Colmon et al. | |
| 4,655,395 | A | 4/1987 | Cioffi et al. | |
| 4,682,729 | A | 7/1987 | Doman et al. | |
| 4,734,451 | A | 3/1988 | Smith | |
| 4,872,511 | A | 10/1989 | Davis | |
| 4,889,189 | A | 12/1989 | Rozniecki | |
| 4,899,827 | A | 2/1990 | Poole | |
| 4,906,164 | A | 3/1990 | Jackman et al. | |
| 4,907,654 | A | 3/1990 | Eberhardt | |
| 4,976,319 | A | 12/1990 | Eberhardt et al. | |
| 5,014,790 | A | 5/1991 | Papavergos | |
| 5,042,476 | A | 8/1991 | Smith | |
| 5,062,487 | A | 11/1991 | Siria et al. | |
| 5,127,554 | A | 7/1992 | Loychuk | |
| 5,154,234 | A | 10/1992 | Carrico | |
| 5,165,484 | A | 11/1992 | Chaput | |
| 5,199,386 | A | 4/1993 | Hubbard | |
| 5,205,648 | A | 4/1993 | Fissenko | |
| 5,211,336 | A | 5/1993 | Kaidonis et al. | |
| 5,273,191 | A * | 12/1993 | Meshberg | 222/105 |
| 5,495,893 | A | 3/1996 | Roberts et al. | |
| 5,497,911 | A | 3/1996 | Ellion et al. | |
| 5,520,331 | A | 5/1996 | Wolfe | |
| 5,597,044 | A | 1/1997 | Roberts et al. | |
| 5,666,947 | A | 9/1997 | McKay | |
| 6,098,897 | A | 8/2000 | Lockwood | |
| 6,189,625 | B1 | 2/2001 | Hopkins | |
| 6,267,183 | B1 * | 7/2001 | Smagac | 169/30 |
| 6,422,320 | B1 | 7/2002 | Mather et al. | |
| 6,536,887 | B2 * | 3/2003 | Barinaga et al. | 347/86 |
| 6,637,518 | B1 | 10/2003 | Hillier et al. | |
| 6,886,640 | B1 | 5/2005 | Duskin et al. | |
| 6,981,659 | B1 | 1/2006 | Hopkins | |
| 7,080,793 | B2 | 7/2006 | Borisov et al. | |
| 7,096,965 | B2 * | 8/2006 | Ozment | 169/44 |
| 2007/0158467 | A1 * | 7/2007 | Knowles et al. | 239/398 |
| 2012/0241535 | A1 | 9/2012 | Carriere et al. | |

OTHER PUBLICATIONS

Senecal et al., "Explosion Suppression in Occupied Spaces", Halon Options Technical Working Conference 1994, May 3-5, 1994, pp. 79-86.

Spring et al., "New Applications of Aqueous Agents for Fire Suppression", Halon Alternatives Technical Working Conference 1993, May 11-13, 1993, pp. 303-308.

Senecal, "Explosion Protection in Occupied Spaces: The Status of Suppression and Inertion Using Halong & Its Descendants", Fenwal Safety Systems, 1993, pp. 767-772.

Lefebvre et al., "Spray Characteristics of Aerated-Liquid Pressure Atomizers", J. Propulsion, vol. 4, No. 4, Jul.-Aug. 1988, pp. 293-298.

Sabersky et al., Fluid Flow a First Course in Fluid Mechanics, 2nd Ed., pp. 299-303 (1971).

Spring et al., "Alkali Metal Salt Aerosols as Fire Extinguishants", Halon Alternatives Technical Conference 1993, May 11-13, 1993, pp. 413-419.

Kibert et al., "Encapsulated Micron Aerosol Agents (EMMA)", Halon Alternatives Technical Conference 1993, May 11-13, 1993, pp. 421-435.

Lewis et al., Combustion, Flames and Explosions of Gases, 3rd Ed., Chapter V, "Combustion Waves in Laminar Flow", pp. 215-218 (1987).

Butz et al., "Application of Fine Water Mists to Fire Suppression", Halon Alternatives Technical Working Conference 1992, May 12-14, 1992, pp. 347-357.

Cote, P.E. et al., Fire Protection Handbook, 17th Ed., Nov. 1992, pp. 4-42 through 4-67, 5-4 through 5-13, 6-184 through 6-201.

International Search Report for International (PCT) Patent Application No. PCT/US07/81999, mailed Aug. 1, 2008.

Written Opinion for International (PCT) Patent Application No. PCT/US07/81999, mailed Aug. 1, 2008.

Background of the Invention for the above captioned application (previously provided).

International Preliminary Report on Patentability for International (PCT) Patent Application No. PCT/US07/81999, issued Apr. 22, 2009.

Notice of Allowance for U.S. Appl. No. 08/240,271, mailed Aug. 9, 1995.

Notice of Allowability for U.S. Appl. No. 08/240,271, mailed Jul. 31, 1995.

Notice of Allowance for U.S. Appl. No. 08/610,746, mailed Jul. 22, 1996.

Notice of Allowability for U.S. Appl. No. 08/610,746, mailed Jul. 22, 1996.

Kuchta, "Investigation of Fire and Explosion Accidents in the Chemical, Mining, and Fuel-Related Industries—a Manual," U.S. Bureau of Mines Bulletin 680, Washington, DC, 1985, pp. 1-84.

Lefebvre, A.H., Atomization and Sprays, Hemisphere Publishing, New York, NY, 1989, pp. 136-140, 142-144, 261-264.

Libersky et al., "High Strain Rate Lagrangian Hydrodynamics, A Three-Dimensional SPH Code for Dynamic Material Response," Journal of Computational Physics, Nov. 1993, vol. 109, p. 67.

Sher et al., "Spray Formation from Pressure Cans by Flashing," Ind. Eng. Chem., 1977, Process Des. Dev., vol. 16(2), pp. 237-242.

Skaggs et al., "Technical Assessment for the SNAP Program," Proceedings, Halon Alternatives Technical Working Conference 1992, Albuquerque, NM, May 12-14, pp. 46-57.

"Carbon Dioxide as a Fire Suppressant: Examining the Risks," U.S. Environmental Protection Agency, Office of Air and Radiation, Publication EPA 430-R-00-002, Feb. 2000, 54 pages.

Abbud-Madrid et al., "The Water-Mist Fire Suppression Experiment (Mist): Preliminary Results from the STS-107 Mission," Seventh International Workshop on Microgravity Combustion and Chemically Reacting Systems, 2003, NASA/CP-2003-212376, pp. 281-284.

Butz et al., "Application of Fine Water Mists to Hydrogen Deflagrations," Proceedings: Halon Alternatives Technnical Working Conference, May 11-13, 1993, Albuquerque, NM, pp. 345-355.

Mawhinney et al., "Water Mist. What is it?" NFPA Journal, 1999, vol. 93(4), available at http://www.spray-uk.com/published/NFPA899WaterMistWhatIsIt.pdf, 3 pages.

Mawhinney et al., "Water Mist Technology Evolves," NFPA Journal, 1999, vol. 93(6), available at http://findarticles.com/p/articles/mi_qa3737/is_199911/ai_n8869530/, 5 pages.

Wickham, "Status of Industry Efforts to Replace Halon Fire Extinguishing Agents," Wickham Associates, Mar. 2002, Stathrum, New Hampshire, USA, disseminated by the USEPA, 54 pages.

International Search Report for International Application No. PCT/US12/29955, mailed Jun. 19, 2012, 3 pages.

Written Opinion for International Application No. PCT/US12/29955, mailed Jun. 19, 2012, 5 pages.

* cited by examiner

FINE WATER MIST MULTIPLE ORIENTATION DISCHARGE FIRE EXTINGUISHER

CROSS REFERENCE TO RELATED APPLICATION

The present application claims the benefits of U.S. Provisional Application Ser. No. 60/862,383, filed Oct. 20, 2006, of the same title, and U.S. Provisional Application Ser. No. 60/887,518, filed Jan. 31, 2007, entitled "MODULAR FINE WATER MIST FIRE SUPPRESSION SYSTEM USING EFFERVESCENT ATOMIZATION," each of which are incorporated herein by this reference in there entirety.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract No. NNC06CA80C awarded by the National Aeronautics and Space Administration.

FIELD OF THE INVENTION

The invention relates generally to suppression of exothermic reactions and particularly to suppression of fires.

BACKGROUND OF THE INVENTION

Having an effective and reliable strategy for fire safety is of the utmost importance, particularly in isolated and enclosed environments, such as in terrestrial vehicles and aircraft, and partial-gravity conditions, such as in spacecraft and extraterrestrial manned enclosures. For example, the National Aeronautics and Space Administration (NASA) uses carbon dioxide ($CO_2$) for fire suppression on the International Space Station (ISS) and halon chemical extinguishers on the Space Shuttle.

While each of these technologies is effective, they also have drawbacks.

The toxicity of carbon dioxide (threshold limit value (TLV)=5000 ppm) requires that the crew wear breathing apparatus when the extinguishers are deployed. Furthermore, the subsequent removal of the discharge $CO_2$ will tax the spacecraft's Environmental Control and Life Support System (ECLSS).

Halon use in future spacecraft has been taken out of consideration by NASA out of observance of the international protocols against substances that destroy the ozone layer. Gaseous agents used in halon fire-fighting systems have been associated with depletion of the ozone layer, and their use is being phased out around the world. A timetable for replacement was developed as part of the Montreal Protocol, which has encouraged a significant effort here and abroad to identify replacement agents that are as effective as halons, but do not impact the environment. To date, this effort has focused on near-term substitution of other halocarbon compounds, including halochlorofluorocarbons (HCFCs), halofluorocarbons (HFCs) and perfluorocarbons. Although halon deployed in low earth orbit (LEO) or farther out will not come into contact with the Earth's ozone layer, NASA protocols require de-orbiting of a spacecraft after deployment of a halon extinguisher because the ECLSS systems have no means of scrubbing bromofluorocarbons. Another issue is the loss of fire protection once the halon system has been discharged.

An important area of research on halon replacements has been in the use of fine water mists for fire suppression. Fine water mist can suppress fires by attacking all three legs of the "fire triangle": heat, radiation, and fuel source. Water mist can take away heat from the fire as both sensible and latent heat. Perhaps surprisingly, research has shown that the sensible heat effects of water are as significant as the latent heat. However, the heat of vaporization is still important in removing energy from the fire. The steam produced can then act as an inerting agent, or diluent, to inhibit fire propagation. Finally, water mist can act to wet surfaces, which reduces the volatilization of solids and thus the amount of fuel present. An additional mechanism by which water mist can inhibit fires is through the attenuation of infrared radiation. A water aerosol becomes an optically dense medium that prevents the infrared heating of unburned surfaces by burning surfaces. Also, the nitrogen gas used in the generation and propulsion of the fine water mist displaces the oxygen, thereby removing a combustion component from the fire.

Fine water mists hold considerable promise as fire suppression agents. Important design criterion for fine water mist extinguishers include the droplet properties of size and momentum, which are in large part controlled by the atomizer/nozzle design. Engineering of fine mist systems for specific applications is needed, because development of fine mist technology is in an early stage.

SUMMARY OF THE INVENTION

These and other needs are addressed by the various embodiments and configurations of the present invention. The present invention is directed to a suppression system and method using a separation member in a containment vessel to separate a carrier/atomization gas from a suppression liquid.

In a first embodiment, a method for suppressing an exothermic reaction includes the steps:

(a) directing an outlet of a suppression device towards an exothermic reaction, such as a fire or deflagration;

(b) opening a valve to permit a suppression liquid and carrier gas in a containment vessel to flow from the containment vessel, the liquid and carrier gas being located in the containment vessel and separated from one another by a movable and/or deformable separation member (such as a piston or membrane);

(c) after the liquid and carrier gas flow from the containment vessel, mixing the liquid and carrier gas to form a suppression fluid, the suppression fluid being in the form of droplets of the liquid dispersed in the carrier gas; and (d) discharging the suppression fluid in a direction of the exothermic reaction.

In another embodiment, a suppression system includes:

(a) a containment vessel comprising a carrier gas and a suppression liquid;

(b) a separation member dividing the containment vessel into first and second portions, the first portion comprising the gas and the second portion the liquid, wherein the separation member is movably disposed in the containment vessel and/or shape changing in response to pressure exerted by the gas;

(c) a nozzle assembly to mix the liquid and gas, when removed from the containment vessel, disperse the liquid as droplets in the gas, and discharge a suppression fluid comprising the droplets entrained in the gas; and (d) an actuator to initiate removal of the gas and liquid from the containment vessel.

The present invention can provide a number of advantages depending on the particular configuration. By way of example, the suppression system can be a portable fire extinguisher UDOS (Universal Discharge Orientation System) that can extinguish fires aboard space-craft in low gravity or microgravity environments or in vehicles, even when the vehicle is upside down. The suppression system is preferably a water mist system that can operate in microgravity, in any gravitational field, or at any orientation. The UDOS can have many desirable features, including a low weight and a totally self-contained and modular design. There commonly is no complex piping to thread through a crowded habitation module and mounting is simplified. A perforated flow tube containing multiple holes allows the liquid to enter the tube from anywhere in the contained liquid volume. This is desirable, since segments of the separation member can be forced against a single opening with the suppression liquid (e.g., water) still remaining in the volume during discharge. Use of a perforated tube allows water to flow almost anywhere within the bladder and still exit via the perforated tube. The separation member separates the water and gas constituents but can still allow the pressure in the gas phase to be successfully transferred to the water/liquid phase to discharge the contents and facilitate the generation of fine water mist droplets. This can remove the gravity requirement of a typical fire extinguisher, which suffers operational problems when discharged on its side. The system can exploit the slow pressure decay of the gas phase during discharge to force the flow of water/liquid from the containment vessel and allow the system contents to be depleted effectively in all orientations. This type of system can be deployed in aircraft, spacecraft, and other vehicles without concern for system orientation with respect to gravity. The system can use a check valve and aspirating venturi to blend the liquid with the propellant/atomization gas. The body housing the venturi can be configured to use minimal turns and length of flow path from inlet to outlet. This keeps the gas and liquid phases well-mixed in the flow. The generation of fine water mist can be enhanced by the presence of a uniform distribution of small bubbles of gas in a continuous flow of water.

These and other advantages will be apparent from the disclosure of the invention(s) contained herein.

"At least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The preceding is a simplified summary of the invention to provide an understanding of some aspects of the invention. This summary is neither an extensive nor exhaustive overview of the invention and its various embodiments. It is intended neither to identify key or critical elements of the invention nor to delineate the scope of the invention but to present selected concepts of the invention in a simplified form as an introduction to the more detailed description presented below. As will be appreciated, other embodiments of the invention are possible utilizing, alone or in combination, one or more of the features set forth above or described in detail below.

DETAILED DESCRIPTION

Figure 1:
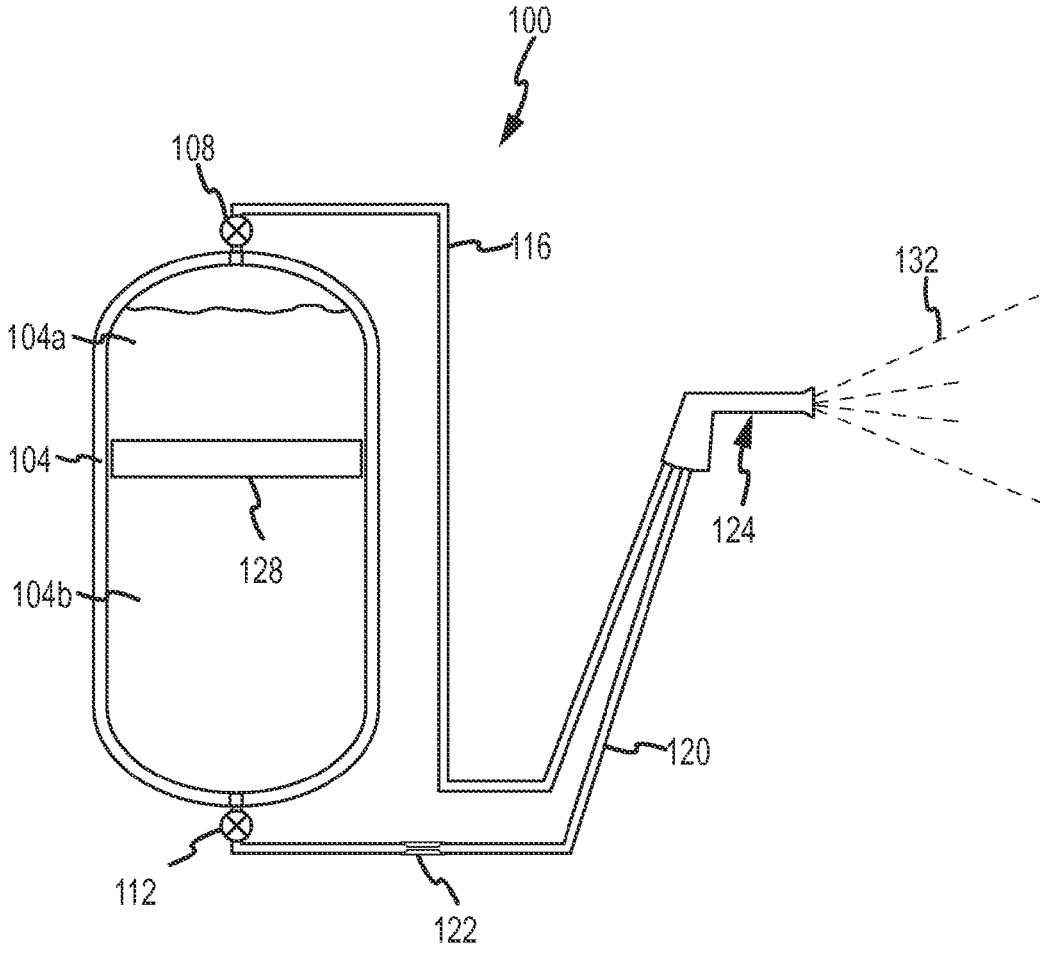
FIG. 1 is an extinguisher according to a first embodiment of the present invention.

FIG. 1 depicts an extinguisher 100 according to a first embodiment. The extinguisher 100 includes a containment vessel 104, first and second valves 108 and 112, respectively, first and second flexible hoses 116 and 120, pressure control 122 (optional) (which controls the liquid pressure in the second hose 120), and a hand-held nozzle assembly 124. The containment vessel 104 is rigid and pressure resistant and includes a movable (rigid) piston 128 positioned between upper and lower portions 104*a* and *b* of the vessel 104. The upper portion 104*a* of the vessel includes a carrier gas while the lower portion 104*b* includes a suppression liquid; therefore, the piston spatially defines the liquid/gas interface.

The first and second valves 108 and 112 are closed when the extinguisher is not in operation and opened when in operation. When the valves are opened, the pressure of the gas and gravity cause the piston to move downwardly, expelling liquid through the hose 120. To make this possible, the gas is discharged through the hose 116 at a rate low enough to maintain a discharge pressure against the liquid. When discharged from the vessel 104, the carrier gas and suppression liquid are maintained in isolation while flowing through their respective hoses 116 and 120. When the gas and liquid reach the nozzle assembly 124, they are mixed together to produce atomized droplets of the liquid dispersed in the carrier gas. The atomized liquid is then discharged from the nozzle assembly 124 at a selected velocity in a cone-shaped pattern 132.

The carrier gas can be any suitable gas that is inert relative to the suppression liquid and substantially immiscible in the liquid under the conditions of the nozzle assembly. Suitable carrier gases include nitrogen, carbon dioxide, air, helium, argon, carbon monoxide, and mixtures thereof.

The carrier gas can be pre-pressured in the vessel 104 or generated rapidly during operation of the extinguisher. In the former case, the carrier gas is typically stored at a pressure ranging from about 100 to about 2500 psi and even more typically from about 300 to about 1200 psi. In the latter case, the carrier gas is generated by combustion of a solid or liquid propellant positioned in the upper half 104*a* of the vessel 104. Although the propellant can be any suitable material, the propellant is preferably selected from the group consisting of lead azide, sodium azide, and mixtures thereof.

The suppression liquid can be any liquid having a heat of vaporization sufficient to absorb the heat as it is generated by the exothermic reaction (e.g., fire, deflagration, or detonation) to be suppressed, a sufficient boiling point to remain in the liquid phase until vaporization by heat absorbtion, and a surface tension sufficient to form atomized liquid droplets. The liquid preferably has a heat of vaporization of at least about 500 cal/g and more preferably at least about 800 cal/g, a boiling point that is no less than about 50 degrees Celsius, more preferably no less than about 80 degrees Celsius, and even more preferably no less than about 90 degrees Celsius, and a surface tension of no more than about 0.06 lbs/ft. A particularly preferred suppression liquid is water. Water offers the added advantages of being cheap, widely available, environmentally acceptable, and nontoxic.

The liquid can include additives to enhance the ability of the liquid droplets to suppress the exothermic reaction, such as free radical interceptors. A preferred free radical interceptor is an alkali metal salt, including potassium bicarbonate, potassium carbonate, sodium bicarbonate, sodium carbonate, and mixtures thereof. The free radical interceptor should have a concentration in the liquid ranging from about 1% up to saturation.

The liquid can include additives to decrease the freezing point of the liquid for applications at low temperatures. As will be appreciated, the freezing point of water is about 0 degrees Celsius, which is above the system temperature in many applications. The liquid can include such freezing-point depressants as glycerine, propylene glycol, diethylene glycol, ethylene glycol, calcium chloride, and mixtures thereof.

The liquid can include other additives to alter the surface tension of the liquid droplets. For example, wetting agents are effective because they decrease the surface tension of the liquid, resulting in the generation of smaller droplets and thus increasing the amount of free surface available for heat absorption. Suitable wetting agents include surfactants.

The liquid can include additives to decrease friction loss in the hoses and nozzle assembly. Linear polymers (polymers that are a single, straight-line chemical chain with no branches) are the most effective in reducing turbulent frictional losses. Poly(ethylene oxide) is an effective polymer for reducing turbulent frictional losses in the liquid.

The nozzle assembly 124 includes a liquid-gas mixing device and an atomization device. The devices can be similar to the liquid atomizing device of U.S. Pat. No. 5,495,893 (which is incorporated herein by this reference), which uses supersonic and sonic fluid velocities to produce a shock wave that decreases the size of the droplets. Alternatively, the devices can be any other devices suitable for mixing and atomization.

The droplet sizes output by the nozzle assembly 124 are small enough to vaporize rapidly in response to heat absorption with sufficient mass to be distributed throughout a defined area. A variable to express the size distribution of the liquid droplets is the Sauter Mean Diameter (SMD). The SMD is the total volume of the liquid droplets divided by their total surface area. The SMD of the liquid droplets is preferably no more than about 150, more preferably no more than about 50, and even more preferably no more than about 30 microns.

The surface area of the droplets in the defined area is a function of the size distribution of the liquid droplets and the concentration of the liquid droplets in the defined area at a selected point in time. In most applications, the peak concentration of liquid droplets in the defined area preferably ranges from about 1.5 gal/1,000 $ft^3$ to about 20 gal/1,000 $ft^3$, more preferably from about 2 gal/1,000 $ft^3$ to about 15 gal/1,000 $ft^3$, and even more preferably from about 4 gal/1,000 $ft^3$ to about 10 gal/1,000 $ft^3$.

Based upon the liquid droplet size distribution and liquid droplet concentration in the defined area, the total surface area per unit volume of the liquid droplets in the defined area at the peak liquid droplet concentration is preferably at least about 75 $m^2/m^3$, more preferably at least about 100 $m^2/m^3$, and even more preferably at least about 150 $m^2/m^3$.

In another configuration, the piston 128 is replaced by a stationary, flexible membrane (not shown). The membrane can be an elastic material, such as an elastomer, and may or may not be permeable to the gas. The membrane is, however, impermeable to the liquid. The membrane is stationary in that its circumference is preferably immovably fixed to the interior surface of the vessel 104. When the second valve 112 is opened, the central portion of the membrane is able to stretch (much like an inflated balloon), in response to gas pressure, to extend substantially the entire length of the lower portion 104*b* of the vessel 104 to expel the liquid.

When the membrane is permeable to the gas, the gas can, over time, migrate through the membrane until a saturated concentration of gas is in the liquid. When the liquid flows out of the tank and the pressure drops, the dissolved gas molecules will rapidly enter the gas phase from the liquid phase, thereby facilitating liquid atomization. Stated another way, the dissolved gas molecules nucleate as small bubbles distributed substantially uniformly in the liquid phase and the bubbles rapidly expand to provide an additional mechanism for generating fine droplets, thereby enhancing droplet generation by the dispersed gas bubbles in the two-phase mixture. This effect is known as effervescence. An emulsifying aid, such as a surfactant or cosolvent, may be added to the liquid to increase the gas molecule solubility up to about 10 wt. %.

Figure 2:
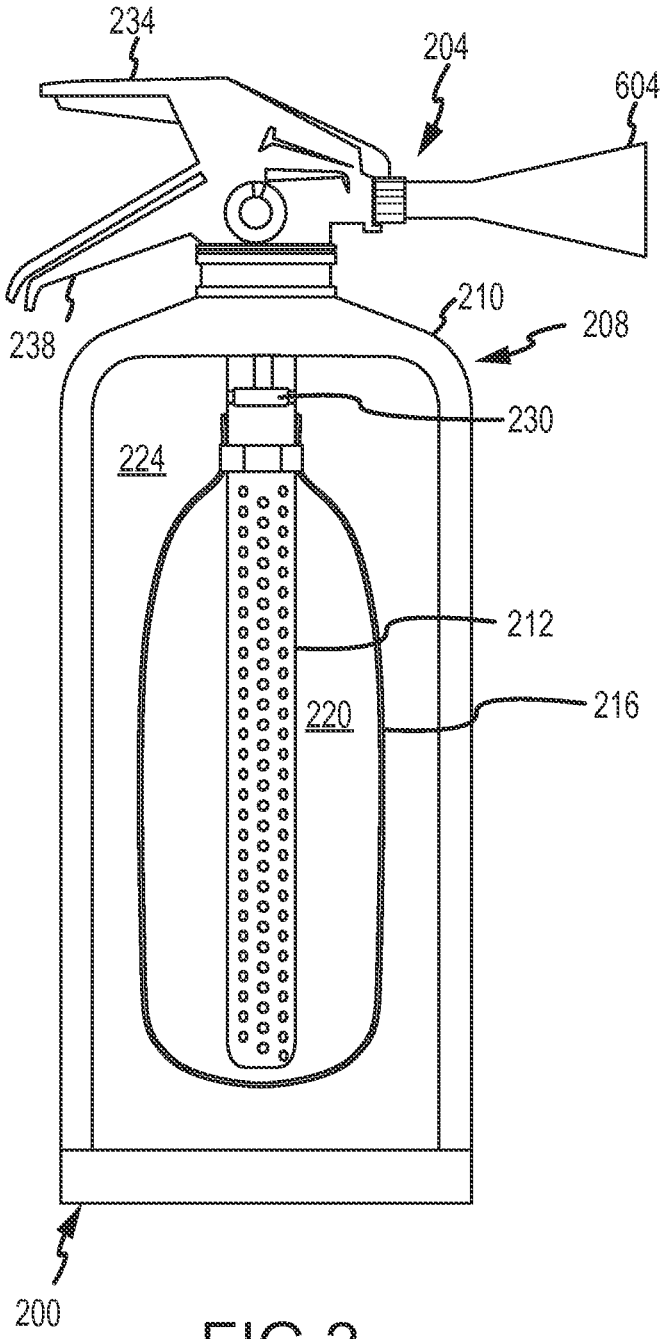
FIG. 2 is a partial cross-sectional view of an extinguisher according to a second embodiment of the present invention.

An extinguisher according to a second embodiment is shown in FIG. 2.

The extinguisher 200 includes a nozzle assembly 204 and a containment vessel assembly 208. The vessel assembly 208 includes a containment vessel 210, a perforated flow tube 212, and an elastomeric membrane or bladder 216 surrounding and enclosing fully the flow tube 212. The membrane 216 divides the inner volume of the vessel 210 into a first (inner) region 220 containing the suppression liquid and a second (outer) region 224 containing the carrier gas.

The vessel assembly 208 can include a piston valve 230 to actuate liquid and gas flow through the upper portion of the tube 212, and the nozzle assembly a mixing and atomization device (not shown) in communication with the tube 212 and located at the top of the tank. The piston valve is actuated by movement of one or both of the handles 234 and 238.

The bladder can be any elastic and/or elastomeric material. Preferably, the bladder has a durometer between about 75 Shore 00 to about 20 Shore 00. Preferred bladder materials include silicone, latex, and ultra-soft Tygon™, with latex being preferred.

Perforations of the tube 212 along substantially the entire length and periphery of the tube provide for uniform and undisturbed liquid flow from the bladder and into the tube.

The percentage of the surface area of the portion of the tube 212 positioned in the bladder 216 that is occupied by perforations is preferably at least about 5% and even more preferably ranges from about 10 to about 30%.

FIGS. 3-7B show an extinguisher according to a third embodiment. With the exception of the piston valve 230 (which is absent), the vessel assembly 208 is the same as that for the second embodiment. The extinguisher of this embodiment includes the vessel assembly 208 and a nozzle assembly 300 attached to the vessel 210. With reference to FIGS. 2, 6A, 6B, 7A, and 7B, the nozzle assembly 300 includes a handle subassembly 600 and a valve subassembly 608. A nozzle 736, such as the nozzle 604, of FIG. 2 may be included depending on the application.

The handle subassembly 600 includes upper and lower handles 612 and 616 connected to a bracket 620. The bracket 620 is, in turn, connected to the valve subassembly 608. The upper handle 612 is movably engaged with the bracket 620 and includes a bearing member 624 that engages a manual release valve 628 of the valve subassembly 608, when the handle is moved towards the lower (stationary) handle 616.

With reference to FIGS. 3-7B, the valve subassembly 608 includes a burst or pressure relief disk 700 (that releases gas pressure when gas pressure in the vessel 208 rises above a determined threshold), a body 704, water and gas fill valve ports 708 and 712, a pressure gauge 716, manual release valve 628, check valve 720, plug 724, venturi 728, and threaded end 732 to threadably engage the vessel 208.

Figure 3:
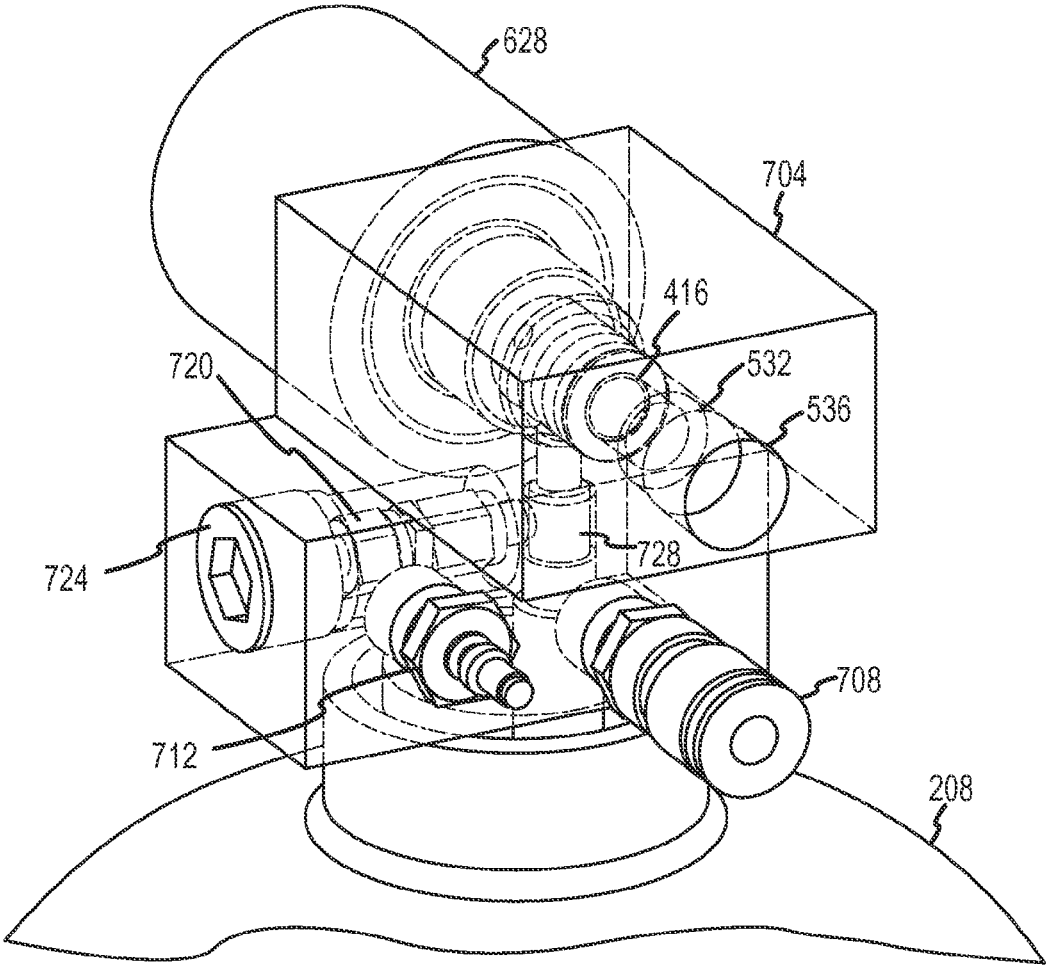
FIG. 3 is a perspective cut-away view of a valve assembly of a third embodiment.
Figure 4:
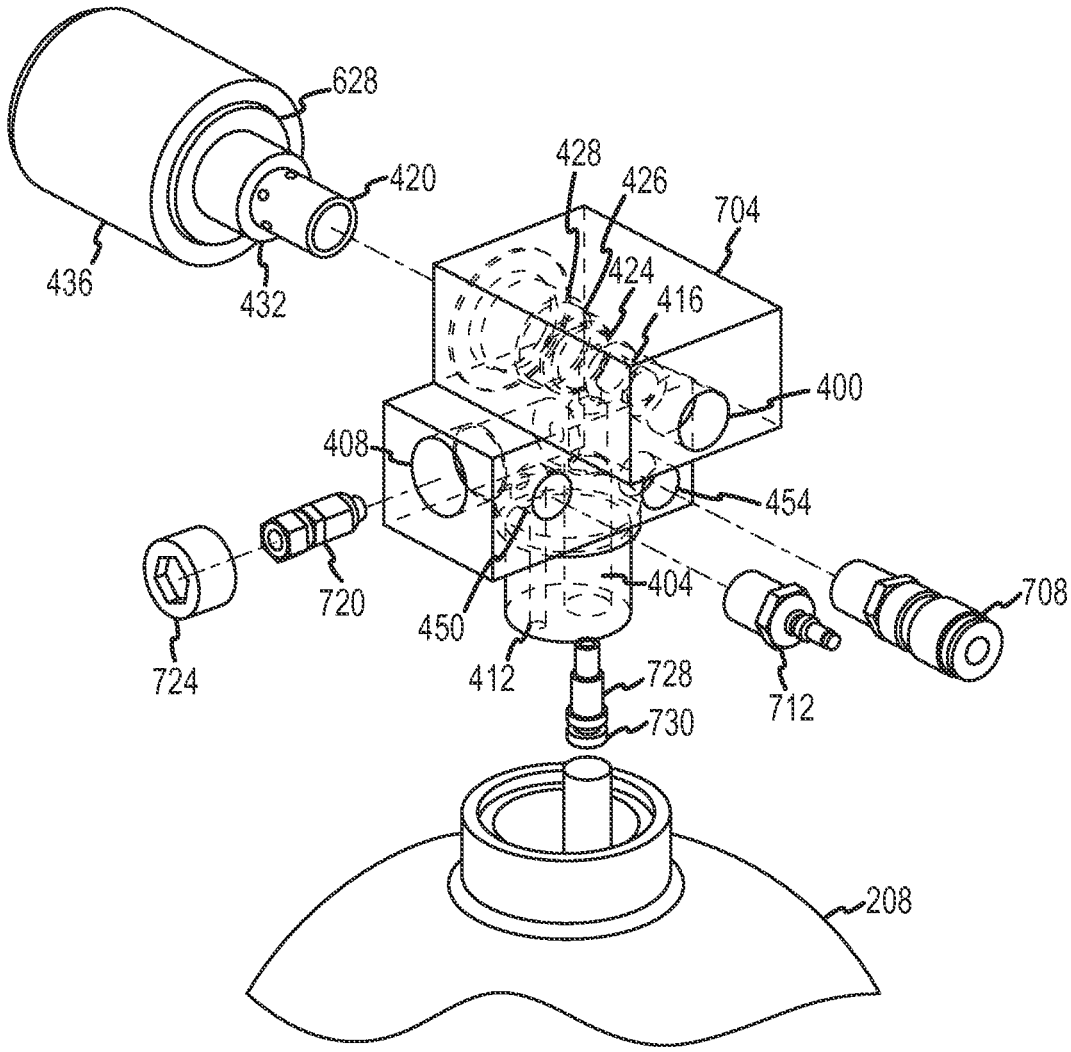
FIG. 4 is a disassembled view of the valve subassembly of the third embodiment.

Additional details of the valve subassembly 608 will now be discussed with reference to FIGS. 3-4. The body 704 comprises first, second, third, fourth, fifth, and sixth interconnecting passageways 400, 404, 408, 412, 450, and 454.

Figure 5:
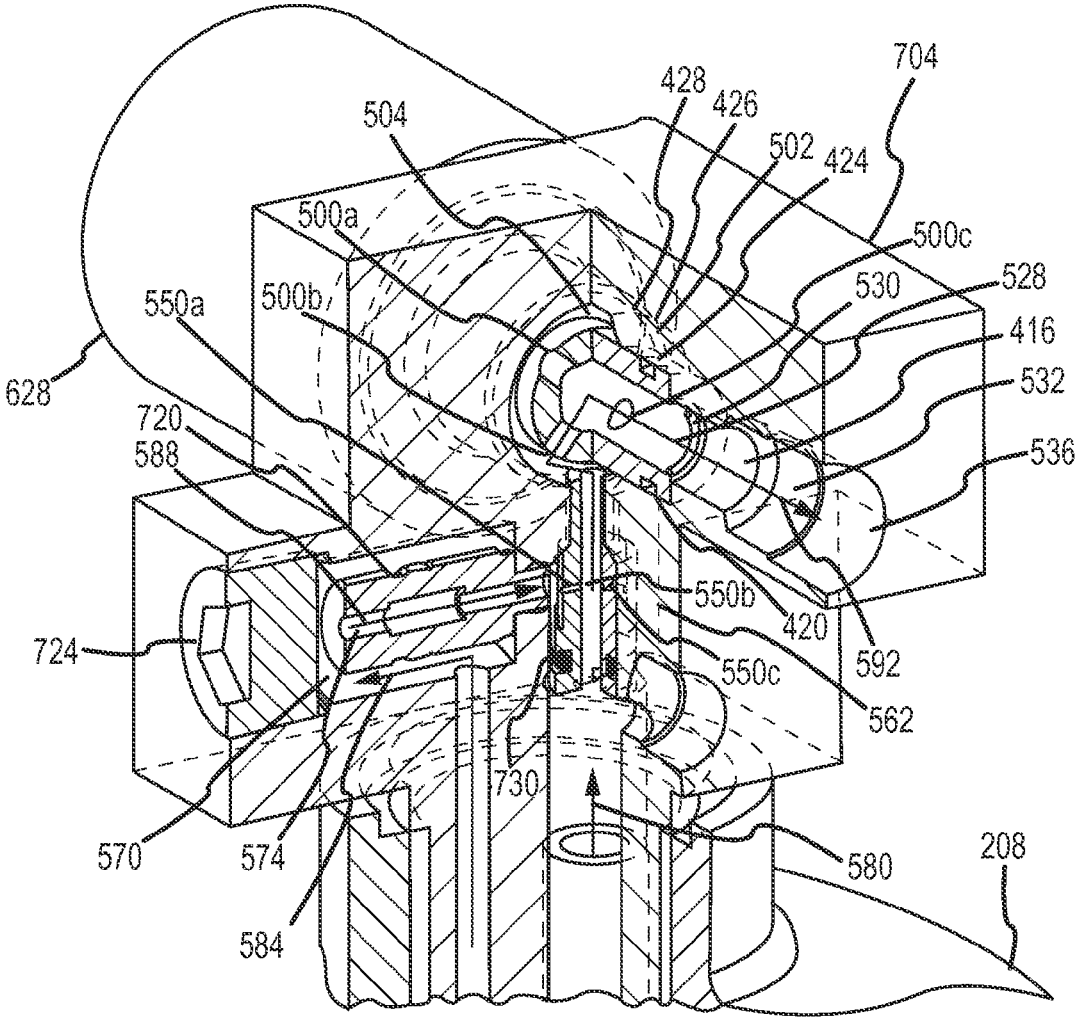
FIG. 5 is a cross-sectional view of the valve subassembly of the third embodiment taken along cut line 5-5 of FIG. 3.
Figure 6A:
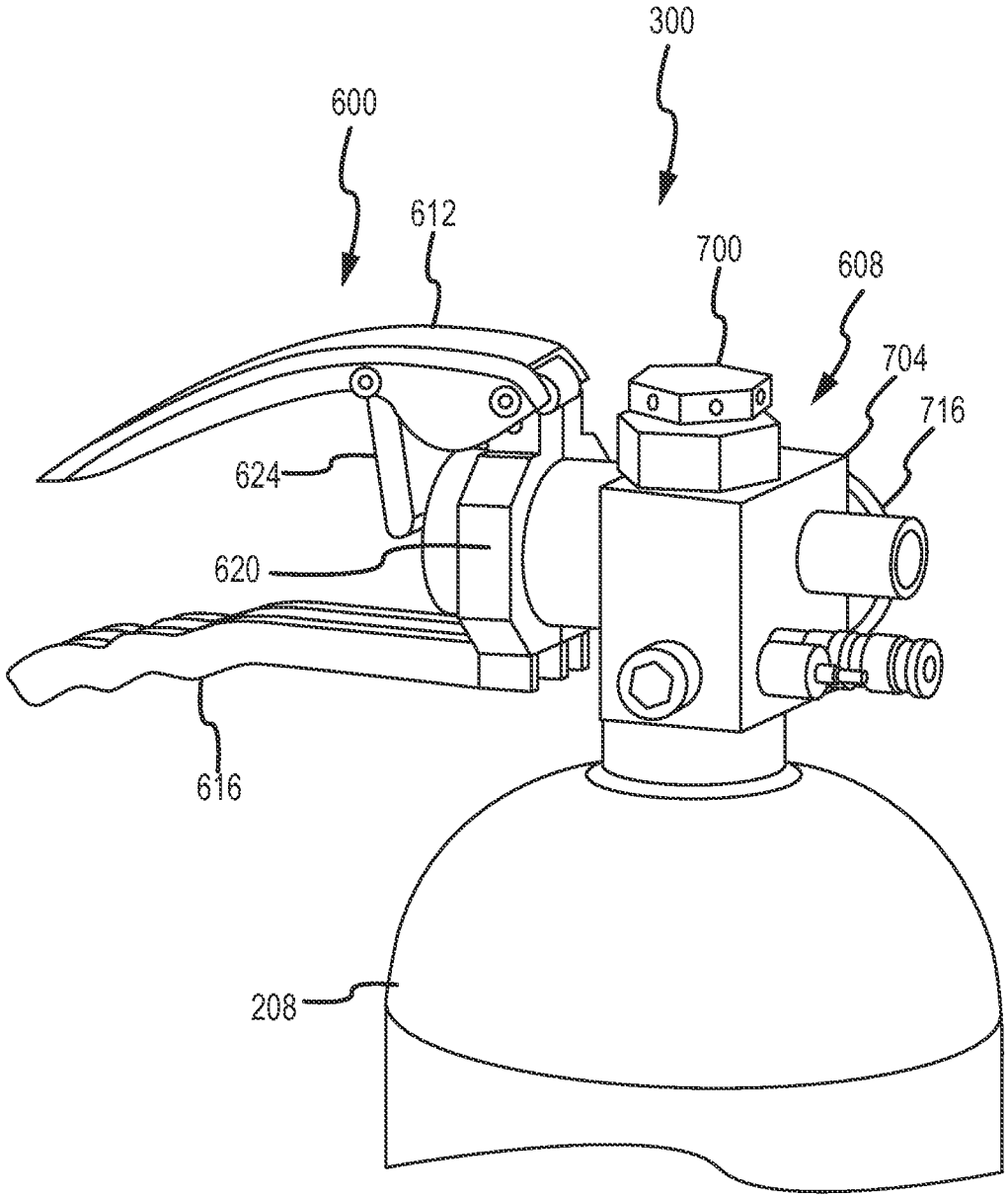
FIGS. 6A and B are side views of the nozzle assembly of the third embodiment.
Figure 6B:
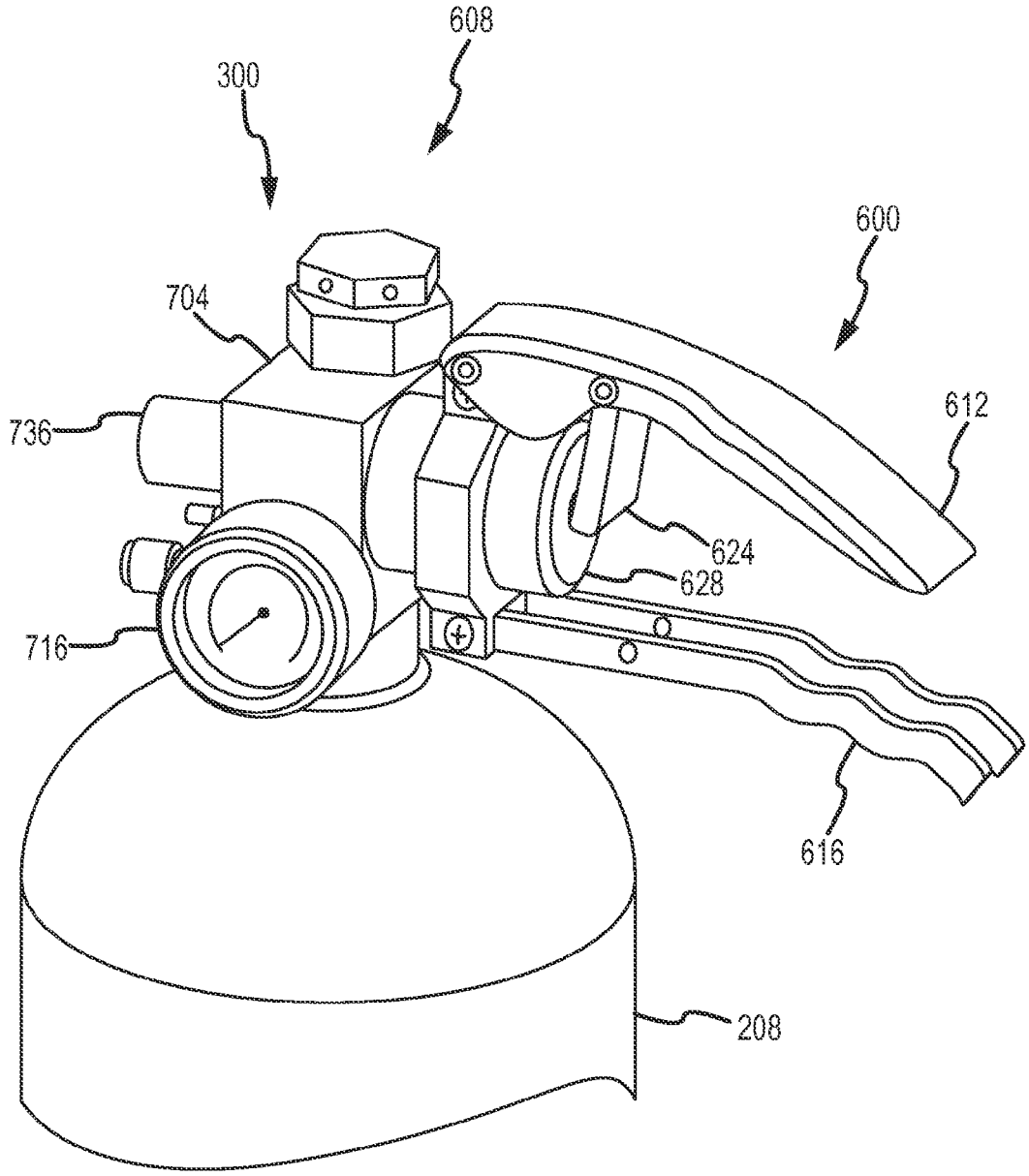
Figure 7A:
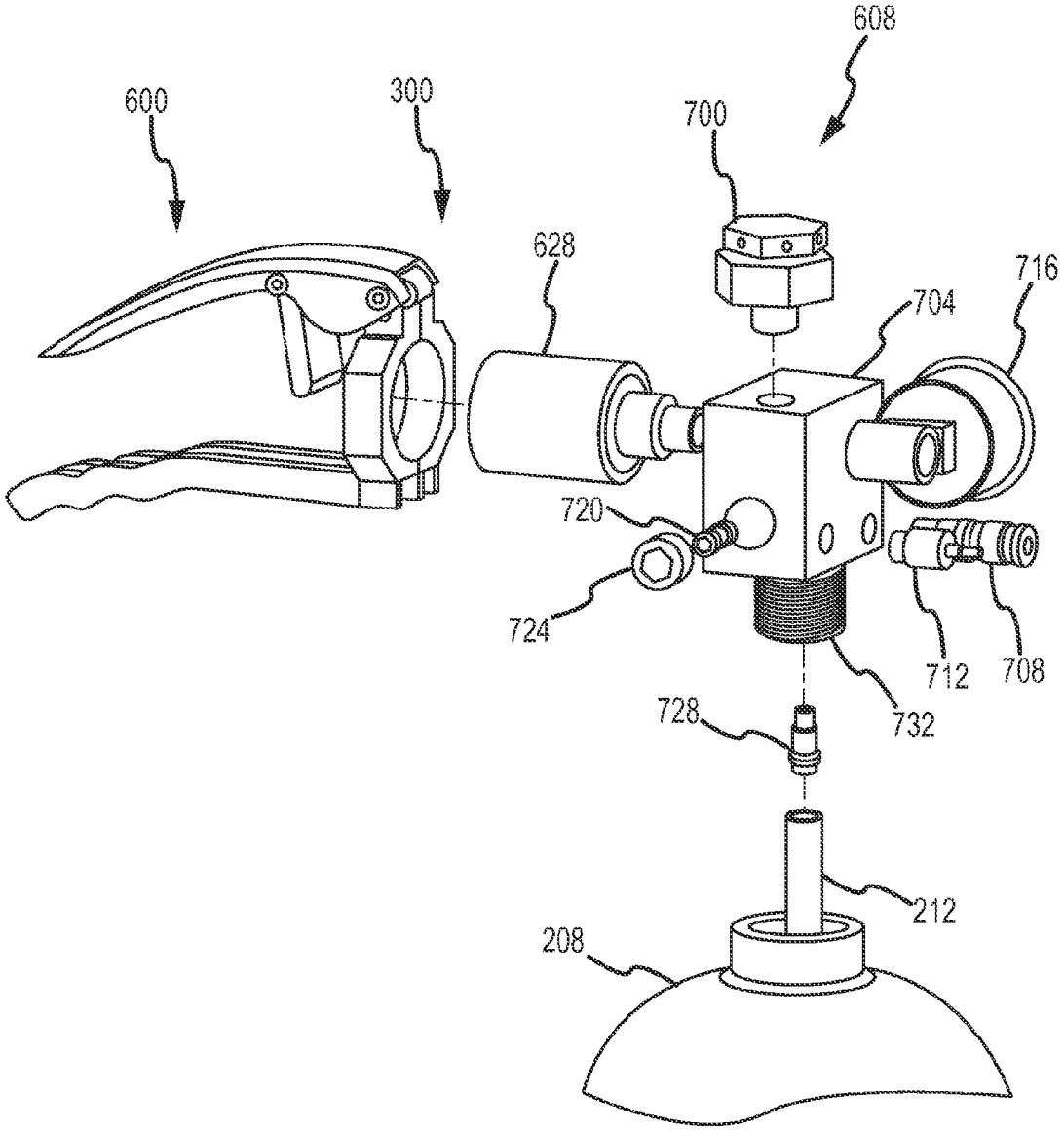
FIGS. 7A and B are disassembled views of the nozzle assembly of the third embodiment.
Figure 7B:
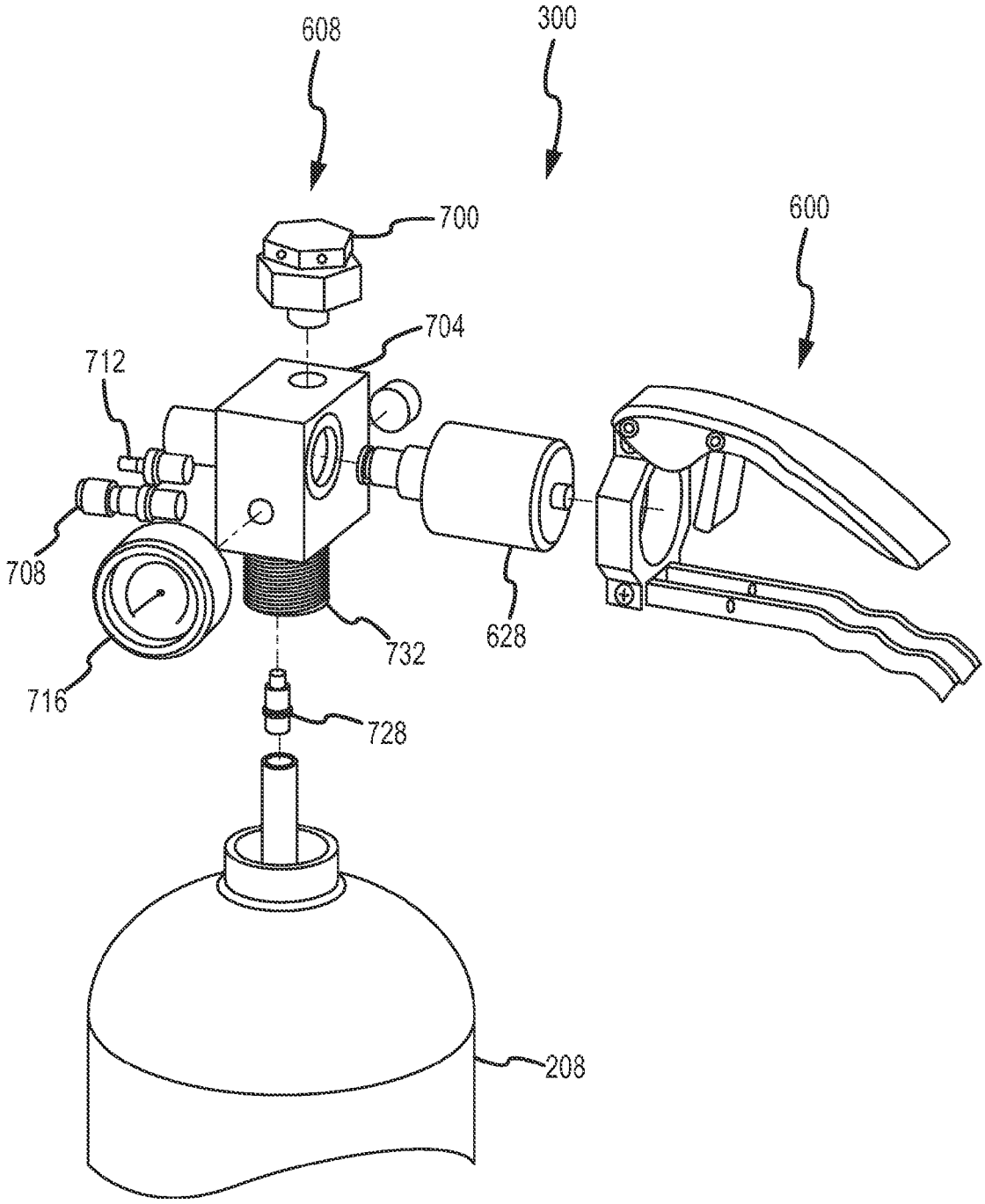

The first passageway 400 receives the release valve 628 and extends longitudinally through the body 704. A smaller diameter segment 424 receives the smaller diameter segment 420 of the release valve 628, while the distal portions 426 and 428 receive the distal portion 432 of the valve 628. As can be seen in FIG. 5, the transition 502 between the portions 424 and 426 is gradual such that ports 500*a-d* (one of which is not shown) in the release valve portion 420 communicate with an annulus area 504 positioned between the exterior of the valve portion 420 and the interior of the passageway segment 426.

As can be seen in FIG. 5, the ports 500*a-d* are in communication with a conduit 508 in the interior of the valve portion 420. The conduit 508 does not pass longitudinally through the valve 628. The conduit 508 is in communication with the smaller diameter segment 416 of the first passageway 400. An orifice plate 530 is positioned in the conduit 508 to provide a restricted flow as discussed in detail below. The proximal end of the first passageway 400 progressively steps into portions of increasing larger diameters 532 and 536.

The second passageway 404 intersects the third passageway 408. The second passageway 404 receives the venturi 728, which is in turn connected to the flow tube 212. The venturi is located in the body, preferably such that there are minimal turns and length to the flow path from inlet to outlet. Referring to FIG. 5, the venturi 728 includes a plurality of tubes 550*a-d* (not shown is tube 550*d*) positioned equidistantly around the circumference of the venturi 728. The tubes are in communication with an outer annulus 562 between the inner surface of the second passageway and the outer surface 558 of the venturi and with an inner passageway 554 passing longitudinally through the venturi 728. Both ends of the inner passageway 554 have tapered configurations to form a constricted throat between them. The throat, when passing the suppression liquid, causes a reduction in pressure. The reduction in pressure draws gas through the tubes into the suppression liquid and forms a dispersion of the gas bubbles in the flowing liquid. The lower end of the venturi includes an "O" ring to prevent liquid and gas discharge from around the larger diameter, lower end 730 of the venturi.

The third passageway 408 communicates with the second and fourth passageways and includes a plug 724 and check valve 720. The passageway 408 has a larger diameter than the check valve 720 to define an annulus 570 therebetween. The flow passage 574 through the check valve is in communication with the annulus 570 and annulus 562. The check valve 720 includes a movable member (not shown) that, when closed, blocks flow in either direction along the flow passage 574 and, when opened, permits flow in either direction along the flow passage 574. The spring pressure for the movable member of the check valve is very light, preferably no more than about 1 psi, since the primary function of the check valve is to inhibit backflow of the liquid to the gas reservoir section of the vessel. A preferred check valve 720 is a 10-32 THD or Barb —CKV manufactured by Beswick Engineering.

The fourth passageway 412 is in fluid communication with the gas in the vessel 208 and the third passageway 408. When not in use, the pressurized gas in the annulus 570 exerts a pressure against the movable check valve member that is opposed by an equal and opposite pressure exerted by the liquid in the bladder 216. Thus, the check valve is in the closed position.

The fifth and sixth passageways 450 and 454 receive, respectively, the gas fill port 712 and water fill port 708. The fifth passageway 450 is in fluid communication with the fourth passageway 412, while the sixth passageway 454 is in fluid communication with the second passageway 404. Each of the ports includes a check valve (not shown) that is closed except when a pressurized fluid flow is inputted into the port. The extinguisher is thus filled by first filling, via the port 708, the bladder with a predetermined volume of water. The filling procedure is completed by subsequently filling with gas the area of the vessel outside of the bladder until a predetermined pressure is realized. The pressure gauge 716 provides the pressure reading in the vessel. The pressure gauge is in fluid communication with the fourth passageway 412 (not shown).

Figure 8:
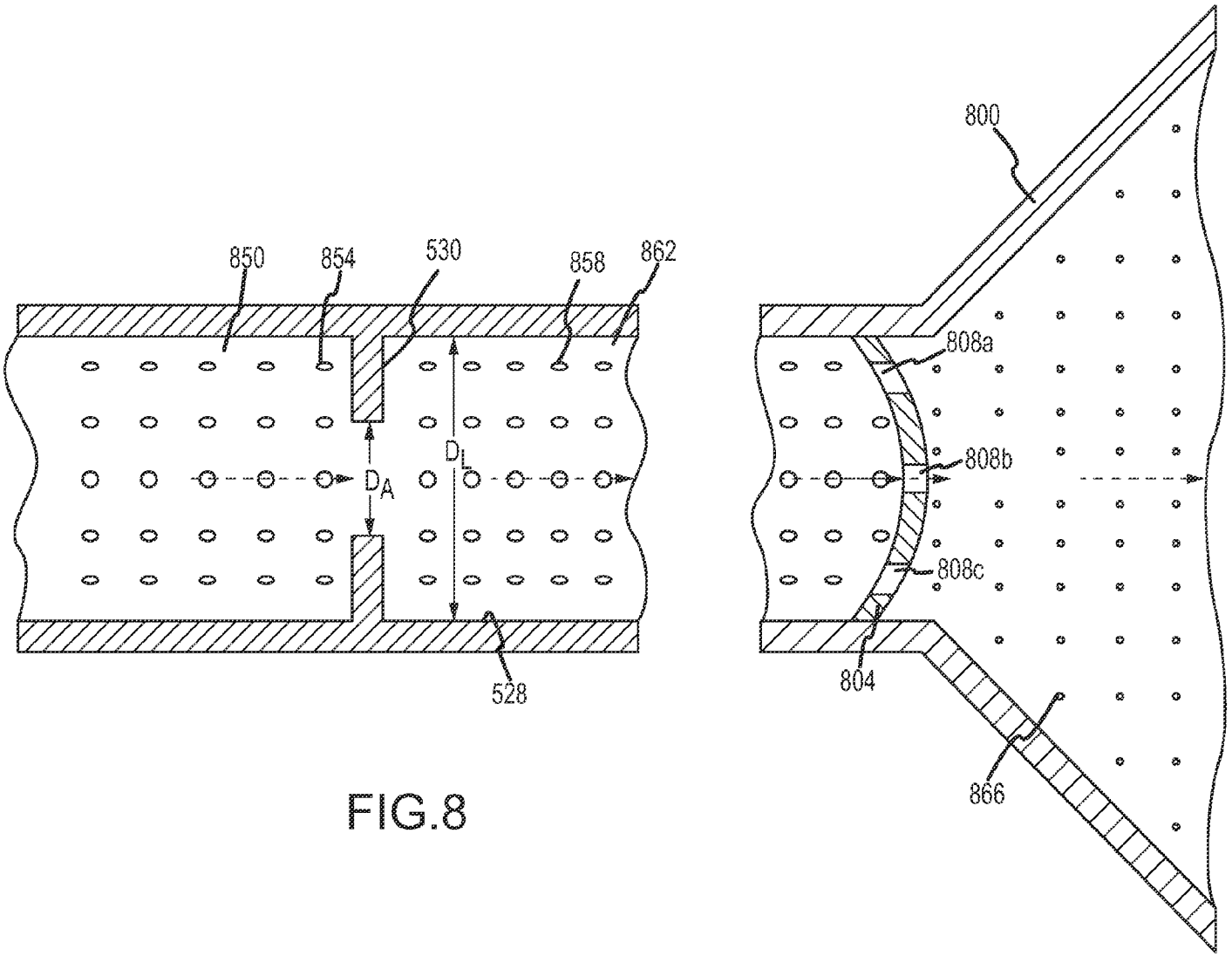
FIG. 8 is a cross-sectional view of a section of the flow path of the nozzle assembly of the third embodiment.

FIG. 8 depicts an alternative configuration of the first passageway. The cross-section is taken along the longitudinal axis of the first passageway 400. The orifice plate 530 is positioned in the conduit 528 of the release valve 628. Downstream of the plate 530 is a nozzle housing 800 and nozzle plate 804. The nozzle plate 804 comprises a number of flow passages 808*a-c* extending through the plate 804. The diameters of the flow passages 808*a-c* are the same and smaller than the diameter "$D_A$" of the aperture in the orifice plate 530. Preferably, $D_A$ ranges from about 10 to about 100% of the diameter $D_C$ of the conduit 528. $D_A$ preferably ranges from about 0.01 to about 0.25 inches, while $D_C$ ranges from about 0.25 to about 0.50 inches. The area of the aperture preferably ranges from about 90 to about 110% of the cumulative area of the passages through the nozzle plate.

Figure 9:
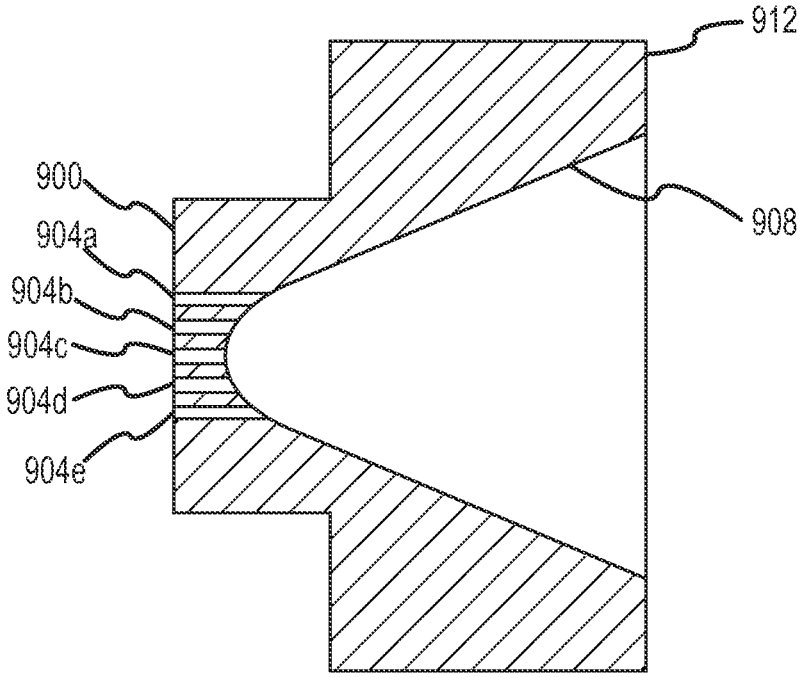
FIG. 9 is a cross-sectional view of a nozzle configured for use with the nozzle assembly of the third embodiment.

FIG. 9 depicts another configuration of an integral nozzle plate and housing that is mounted in the outlet of the first passageway. The nozzle plate 900 includes a number of flow passages 904*a-e*. The interior surface 908 of the housing 912 is arcuate to provide a smoother, less turbulent flow path. As will be appreciated, the nozzle plate 900 may include any number of passages 904 depending on the application.

The operation of the extinguisher of the third embodiment will now be discussed with reference to FIGS. 2-8.

An operator activates the extinguisher by gripping and squeezing the upper and lower handles 612 and 616 to move the upper handle towards the lower handle. In response, the bearing member 624 displaces the manual release valve 628 inwardly along the first passageway 400, bringing the ports 500*a-d* into fluid communication with the annulus 504. When not in operation, the liquid flows through the tube 212 and into the second passageway 404. Liquid flow into the third passageway 408 is blocked by the closed check valve 720 and flow through the proximal portions 532 and 536 of the first passageway is blocked by the valve portion 420. This is so because the ports are not in fluid communication with the annulus 504. When the valve 628 is displaced inwardly along the first passageway, the ports 500*a-d* move into the annulus 504. This displacement into the annulus 504 effectively releases pressure on the liquid and gas simultaneously with the gas pressure providing the motive force via the bladder to cause the liquid to flow from the vessel. The gas and liquid constituents can be mixed either at the nozzle or in the liquid and gas transfer conduits from the bladder to the nozzle.

In response, the liquid, under pressure from the gas outside of the bladder 216, flows (as shown by flow path arrow 580) into and through the venturi 728. During discharge, the static pressure of the liquid decreases as the liquid moves through the venturi throat. The reduced liquid pressure at the throat of the venturi causes a pressure differential across the aspirating tubes of the venturi, which displaces the moveable closure member of the check valve (not shown) and pulls the gas through the check valve and into the discharge. In other words, the liquid pressure at the throat is less than the pressure of the gas in the annulus 570, thereby causing the check valve closure member to move to the open position and gas to flow into the annulus 562 (as shown by flow path arrow 584) and into and through the aspirating tubes 550*a-d* (as shown by flow path arrow 588). The gas and liquid will thereby be mixed at the throat to form gas bubbles (the discontinuous phase) dispersed in the liquid (the continuous phase). As used herein, "continuous phase" refers to the phase constituting at least about 75% by volume of the fluid. As will be appreciated, the size of the carrier gas bubbles is related inversely to the velocity of the liquid past the tubes 550*a-d* and directly related to the diameters of the tubes. The velocity of the liquid shears carrier gas bubbles from the tubes, with the shear forces being increased at higher velocities. Preferably, the stored pressure of the gas and throat diameter are selected to provide a velocity of the liquid through the throat of at least about 50 ft/sec and even more preferably ranging from about 50 to about 300 ft/sec. The stored pressure of the gas preferably is at least about 150 psi and even more preferably ranges from about 300 to about 1200 psi, while the throat has an interior diameter of no more than about 0.2 inches and even more preferably ranging from about 0.08 to about 0.2 inches. The diameter of each tube 550 preferably ranges from about 0.02 to about 0.05 inches. After mixture, the mass ratio of the gas to the liquid is typically no more than about 0.05 to about 0.3 and even more preferably ranges from about 0.08 to about 0.20.

As shown by flow path arrow 592, the fluid mixture flows into the annulus 504 surrounding the proximal end of the release valve. Although the cross-sectional area of the annulus 504 normal to the direction of flow is more than the cross-sectional area normal to flow of the outlet passage between the annulus 504 and the venturi, the liquid phase remains the continuous phase while the gas phase remains the discontinuous phase. The fluid at the venturi outlet and in the annulus 504 is preferably from about 20 to about 70% by volume carrier gas.

The fluid then flows from the annulus 504, through the ports 500*a-d*, into the conduit 528. Each of the ports 500*a-d* typically have a diameter ranging from about 10 to about 60% of the diameter $D_C$, or, in absolute terms, from about 0.01 to about 0.2 inches. Because the cross-sectional area of each port normal to the direction of fluid flow is less than the cross-sectional area normal to liquid flow at any other upstream location (except in some cases at the throat of the venturi), the ports cause the liquid droplets to accelerate and have a higher velocity in the conduit 528 than in the annulus 504. This velocity is commonly no more than about 1,000 ft/sec and no less than about 100 ft/sec.

Once in the conduit 528, the gas-containing liquid flows through the orifice plate 530 as shown in FIG. 8. After passage through the orifice plate 530, the liquid becomes the discontinuous phase, and the gas the continuous phase. The increased flow area downstream of the orifice plate 530 causes the carrier gas to expand, and the liquid to form dispersed droplets in the gas. By way of comparison, the fluid at the venturi outlet is preferably from about 20 to about 70% by volume carrier gas, and the fluid immediately downstream of the orifice plate is preferably from about 50 to about 95% by volume carrier gas. Due to the restricted size of the diameter DA, the fluid reaches the maximum velocity at the aperture. The maximum velocity is preferably at least a supersonic velocity. As will be appreciated, a sonic velocity is about 1100 ft/sec in a neat gas (or the speed of sound); sonic velocity can be considerably lower in a two-phase flow mixture. A supersonic velocity is greater than a sonic velocity. The pressure at the aperture preferably ranges from about 20 psig to about 250 psig. Preferably, to attain sonic and supersonic fluid velocities, the maximum fluid pressure in the first passageway downstream of the orifice plate is no more than about 53% of the fluid pressure at the aperture.

Downstream of the conduit 528, the cross-sectional area of the passageway normal to the direction of flow progressively increases, with the passageway segment 416 having a larger diameter than the diameter $D_C$, the passageway segment 532 a larger diameter than the passageway segment 416, and the passageway segment 536 a larger diameter than the passageway segment 532. As a result of the increase in the flow area, the droplet velocity will progressively decrease.

The deceleration of the droplets from a supersonic velocity to a sonic velocity decreases the size of the droplets, as a result of the pressure discontinuity from the resulting shock wave. In other words, the liquid droplets upstream of the shock wave have larger average, mean, and median sizes than the liquid droplets downstream of the shock wave. The distance from the aperture to the first passageway outlet should be sufficient to enable the shock wave to occur in the first passageway upstream of the outlet. Preferably, the distance from the aperture to the passageway outlet is at least twice the distance from the aperture to the point of formation of the shock wave.

The decreased liquid droplet size is believed to result from the liquid droplets having a Weber number that is no more than about 1.2. It is generally believed that the liquid droplets downstream of the shock wave have an average size that is no more than about 50% of the average size of the droplets upstream of the shock wave. The liquid droplets upstream of the shock wave preferably have an SMD of no more than about 160 microns and the liquid droplets downstream of the shock wave an SMD of no more than about 80 microns. The liquid droplets outputted from the first passageway preferably have a velocity of at least about 200 ft/sec.

In a preferred embodiment, the fluid next passes through the passages 808 in the nozzle plate 804 to realize further reduction in the droplet size as shown in FIG. 8. As shown in FIG. 8, upstream of the orifice plate 530 the liquid 850 contains carrier gas bubbles 854. Downstream of the orifice plate 530, the liquid 850 forms droplets 858 while the gas 862 expands to form the continuous phase. When the fluid passes through the nozzle plate 804, further droplet size reduction occurs due to shearing by the passages 808 such that the average, mean and median sizes of the droplets 866 are smaller than those for the droplets 858.

To suppress an exothermic reaction such as a fire or deflagration, the liquid droplets must be rapidly dispersed in the area of the reaction. The injection rate and velocity of the liquid droplets exiting the extinguisher can be important variables to the ability of the extinguisher to extinguish the reaction. The liquid droplet injection rate per unit volume of the reaction area preferably is at least about 1.5 l/sec/$m^3$, more preferably at least about 3 l/sec/$m^3$, and most preferably at least about 5 l/sec/$m^3$. In most applications, the liquid droplet injection rate will preferably range from about 0.5 to about 10 l/min. The velocity of the liquid droplets exiting the first passageway outlet preferably ranges from about 100 ft/sec to about 500 ft/sec and more preferably from about 150 ft/sec to 300 ft/sec.

Figure 10:
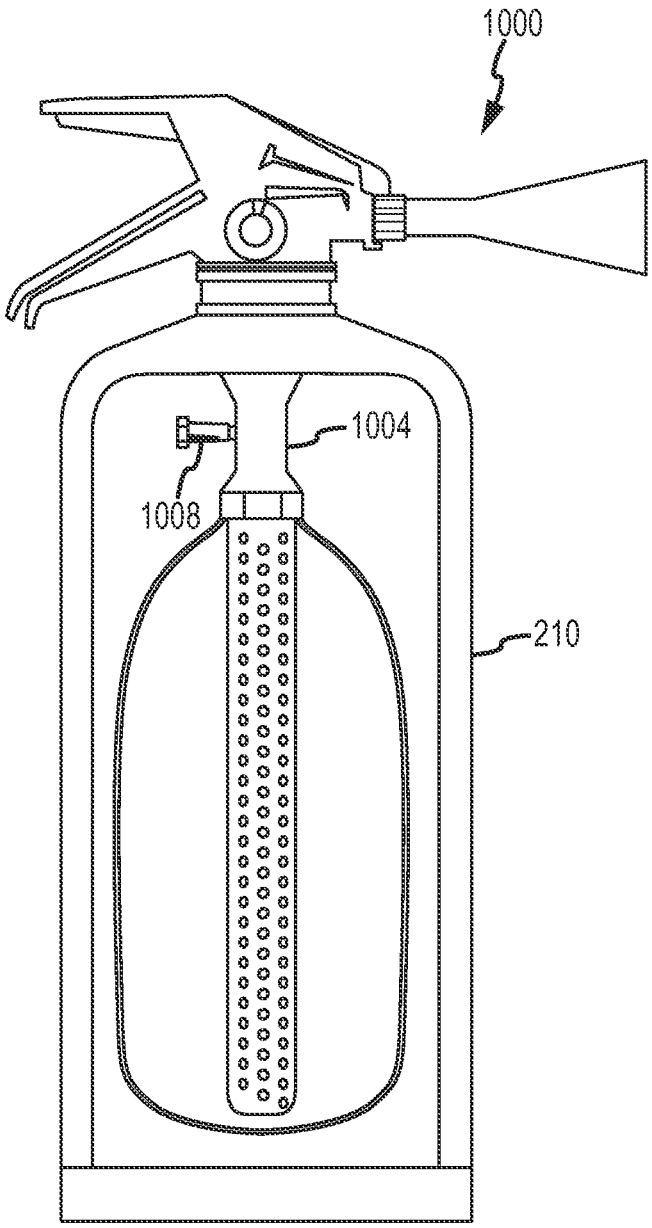
FIG. 10 depicts an extinguisher according to a fourth embodiment of the present invention.

Another embodiment of the extinguisher is shown in FIG. 10. The extinguisher 1000 differs from the extinguishers of the other embodiments in that the venturi 1004 and check valve 1008 are positioned inside of, rather than outside of, the containment vessel 210. When liquid flow from the vessel 210 is initiated, the check valve opens due to the resulting pressure differential across it, and gas flows into the aspirating ports of the venturi 1004 as noted above.

EXPERIMENTAL

Various tests were performed to determine the efficacy of the extinguisher in suppressing fires. Two proof-of-concept test systems were conceived, built, and evaluated that separated liquid and gas components in a single storage tank so that the system could function under microgravity environments. Two design concepts were considered. One was a free piston concept, such as that of FIG. 1, in which water was stored on one side of the piston and nitrogen gas on the other side in a single tank. As the system discharged, the expanding gas would push the piston toward the liquid discharge end of the single container. There were concerns over the ability to maintain the gas to liquid ratio in the discharge stream over a specified range with this configuration, and this concept was abandoned in favor of an alternative approach.

Figure 11:
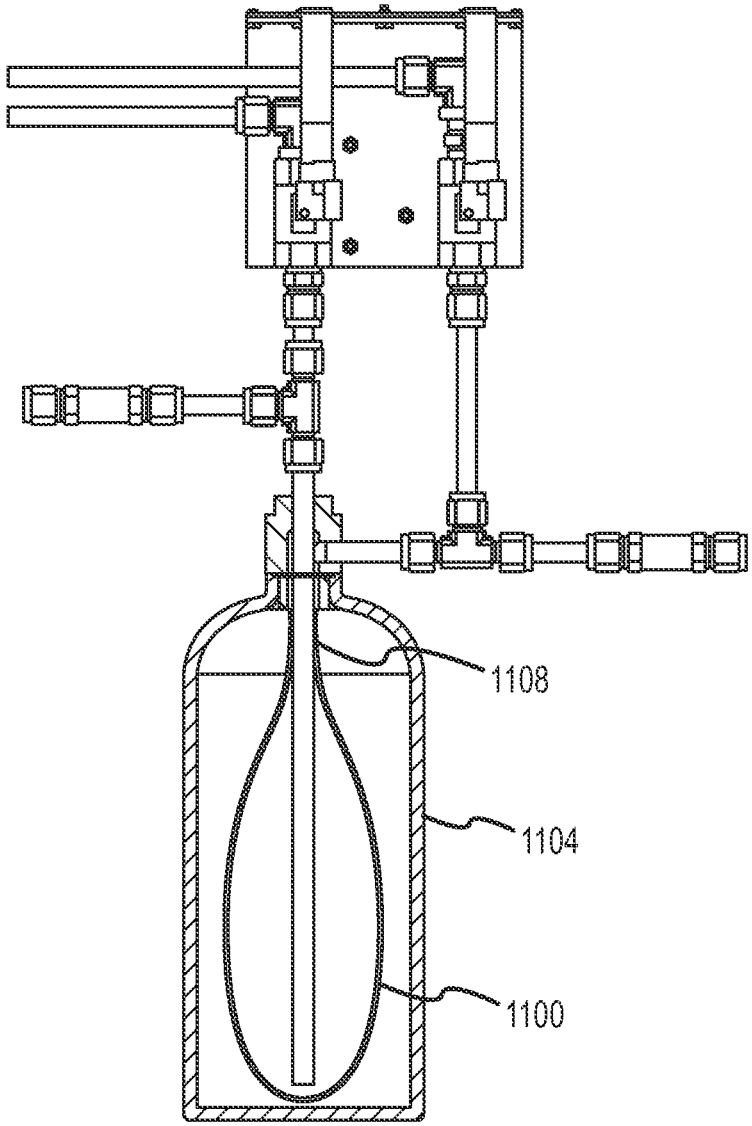
FIG. 11 is a view of an experimental apparatus according to an embodiment of the invention.

The second concept shown in FIG. 11 used a bladder 1100 to separate the gas and liquid phases in the single storage tank 1104. This design employed a bladder. The bladder was fitted over the perforated flow pipe and inserted into the vessel. The bladder was filled with water while inside the tank, and sealed with a valve. The carrier gas was then filled through a second port after its separate discharge valve had been seated. As shown by FIG. 11, release of both water and carrier gas was controlled by a single mechanism that simultaneously operated both valves. Mixing of water and gas occurred downstream of the valves and upstream of the discharge nozzle. Two pneumatically actuated quarter turn ball valves were used.

Bladder materials evaluated were permeable to $CO_2$ gas so that $CO_2$ could dissolve into the liquid water, generating equilibrium with the gas phase in the single tank 1104. The decision to specify nitrogen as the preferred carrier gas allowed the consideration of a wider range of bladder materials.

One approach to inserting the bladder material into the relatively small hole in the top of a commercially available storage tank pressure vessel was to use elastic tubing for the bladder. To evaluate this design, ½" diameter elastic tubing capable of expanding to 4-6" in diameter was fitted over a perforated stand pipe and clamped at both ends. After inserting the flow tube 1108 into the tank 1104, the tubing was filled with water and stretched out to maintain containment of the water inside the tank, much like a constrained balloon. Multiple materials were tested for the bladder, including silicone, Latex, and ultra-soft Tygon®. Latex was the only tubing that expanded to the required diameter, and it held water for 3 months with minimal leakage. For this reason, Latex was used in the prototype system.

A concept nozzle design, similar to that of FIG. 9 (hereinafter ADA#1), to generate a lower-momentum flow of fine water mist was fabricated and evaluated. Two factors for fine water mist to extinguish fires in confined and cluttered spaces appear to be 1) droplet size distribution where most of the water mass is contained in droplets less than about 30 microns in diameter, which have a high surface area for rapid evaporation, and 2) minimal momentum of the droplets so that the mist can move easily around barriers in a cluttered environment to get to a well-obstructed fire. Having one of these properties without the other reduces the ability of the fine water mist to extinguish a fire in a confined space. Because decreasing the momentum can reduce the flow or create a non-uniform flow, an ideal discharge nozzle design will offer high flows combined with minimal spray momentum.

The nozzle design that had a uniform discharge with small droplet size and minimal momentum was coupled to the system of FIG. 11. Many tests were run to optimize the gas-to-liquid ratio (G/L) as well as the flow rates between the tank and nozzles. The preferred configuration was a G/L of ~0.15 with a 0.1" diameter orifice restriction between the tank and nozzles. This configuration along with the valve determined from earlier tests gave a uniform discharge of nitrogen and water for 40-45 seconds.

Using the system of FIG. 11, two types of tanks were used for nozzle evaluation. The difference between the two storage tanks is volume: one is a 205-$in^3$ vessel while the second is 408 $in^3$; these are standard pressure vessels for commercial 5 and 101*b* carbon dioxide fire extinguishers. The 5 lb vessel was later removed from further testing because the discharge times were extremely small 10-25 seconds depending upon the nozzle used.

The prototype systems were found to effectively extinguish the fires. Both the nitrogen evaluation tests and the fire suppression validation tests are described below.

Multiple fire suppression tests were performed using nitrogen or carbon dioxide gas propellant with water using a fine water mist fire suppression system. In these tests, a 10'×10'×10' free-standing fire test room was used with an oxygen-enhanced fire located at the center of the floor.

The pan that used to hold the fire is 18" wide, 4.5" deep, and has a 1.5" platform around the edge. A hole was drilled at the base of the pan to allow excess water to drain from the pan. Along the edge of the pan two thermocouples were placed to aid in determining if the fire is extinguished. The oxygen gas was pumped through an oxygen service regulator to a flow meter, which is set to 20 scfh. Once through the regulator, an electrically actuated oxygen service ASCO solenoid valve with ½" connections is used to allow oxygen flow to the fire pan. All of the plumbing is ¼" tube except the ball valve and oxygen aspiration system.

The oxygen then enters a dispersion device. The dispersion device is a 1" tube perforated with holes. 0.5 lbs of rags are bundled around and on top of the tube to fuel the fire. The tube is capped at the end opposite of the ¼" tube inlet. Two thermocouples were placed above the fire to monitor fire intensity throughout testing.

The igniter is a piece of nichrome wire crimped onto a length of two-strand wire. One igniter is consumed during each fire test. The igniter is powered by 120 V activated by a mechanical relay with a 25 amp fuse to prevent blowing the main circuit. It is operated on a separate circuit. The relay switch is 1 second in duration. During the fire tests oxygen is allowed to flow for 10 sec. before the igniter is activated. The target fire is ignited and allowed to build to a specified intensity as measured by the thermocouples.

The fine water mist fire extinguisher is filled with carrier gas and water at a predetermined mass ratio (typically 0.15 parts carrier gas to one part water), which has been shown in earlier tests to be the optimal mix for a fine water mist fire suppression nozzle. In all of these tests the fires were successfully extinguished.

Table 1 shows that the carbon dioxide propellant was nominally quicker to extinguish the test fires in all tests. The tests were run at a starting pressure of 850 psi in the single storage container, which represents the condition where the $CO_2$ propellant will be present in the storage tank in both the gas and liquid phases

TABLE 1

Extinguishment times for carbon dioxide and nitrogen propellant systems.

| Propellant | time to extinguish (seconds) |
|---|---|
| Nitrogen | 35 |
| Nitrogen | 34 |
| carbon dioxide | 27 |
| carbon dioxide | 21 |

Due to concerns with a build-up of $CO_2$ concentration with the discharge of a fire extinguisher in small confined areas, nitrogen was selected as the carrier gas. Results that showed the capability of a nitrogen propellant configuration to successfully extinguish test fires reinforced this decision.

An open fire was suppressed by the system of FIG. 11 using a high momentum nozzle in 26 seconds.

The system of FIG. 11 was deployed inverted to show that the system was capable of extinguishing test fires in other orientations than upright. During this test the system extinguished the fire in 17 seconds, and bladder system showed no failure. The inverted extinguisher put out the test fire quicker than the right-side-up system. Both configurations showed good fine mist generation and dispersion.

Following the fire evaluations, the fine water mists generated by several candidate nozzles were characterized in a configuration similar to that of FIGS. 3-8. The mist was characterized by measuring droplet size and velocity distributions using a phase Doppler particle analyzer. This instrument makes local measurements in a discharge spray in a volume of a few $mm^3$. The results showed that one nozzle (ADA#1) exhibited lower momentum and similar droplet size distributions compared to the commercially available nozzles. Sauter mean diameters were similar, indicating that the droplet specific surface area (surface area per unit volume) generated by the different nozzles was comparable. This nozzle data showed a notably higher Dv90 diameter, implying that there is a "tail" of larger-diameter droplets generated in the ADA nozzle.

Figure 12:
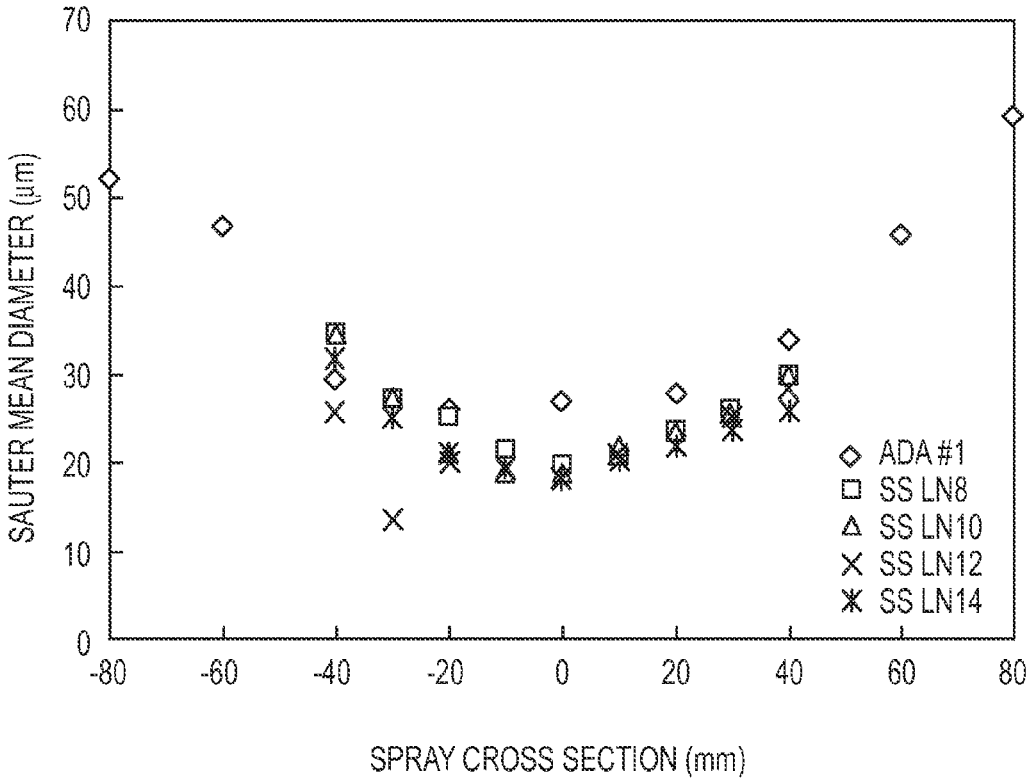
FIG. 12 is a plot of Sauter Mean Diameter (vertical axis) against spray cross section (horizontal axis)
Figure 13:
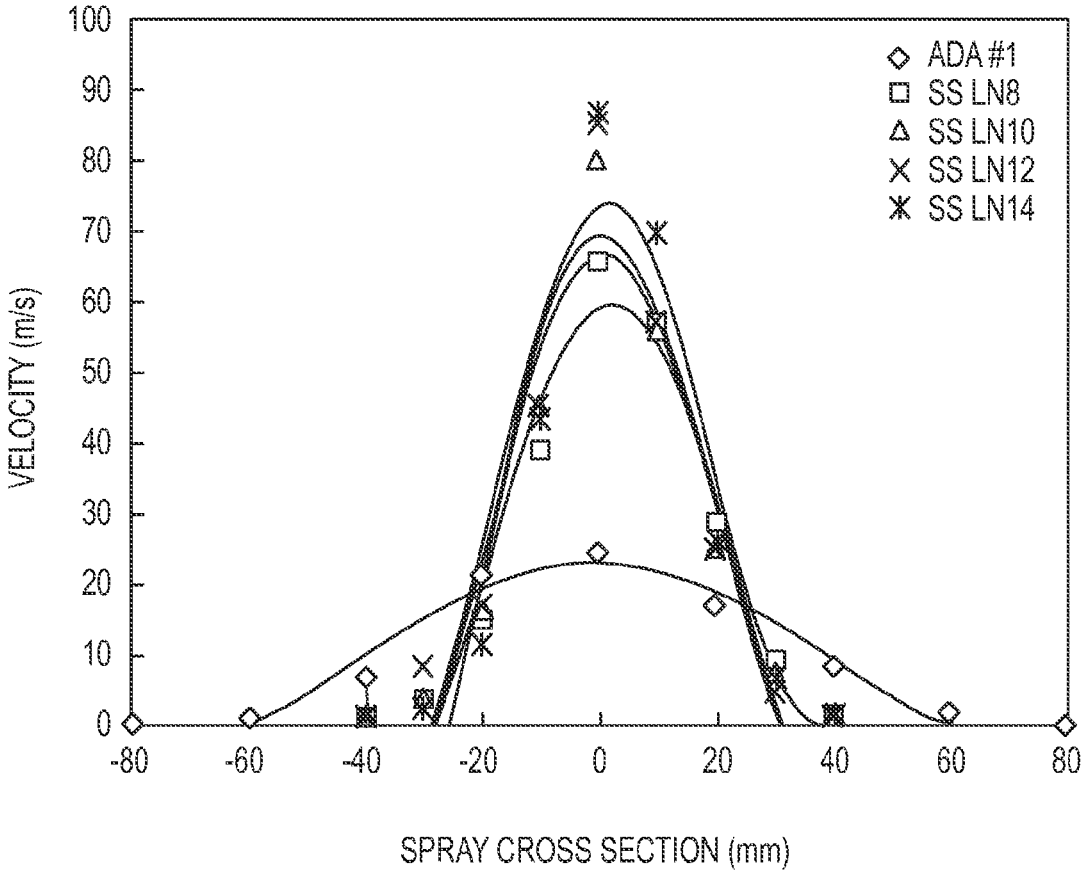
FIG. 13 is a plot of droplet velocity (vertical axis) against spray cross section (horizontal axis)

FIG. 12 presents the droplet size distribution as a function of distance along the spray center line, and FIG. 13 the droplet velocity also as a function of distance along the spray center line. The ADA#1 nozzle showed a spray profile with a greater cone angle (faster expansion) than the other nozzles; this is indicated in sampling locations that are spaced at twice the interval of the other nozzles. The velocity profile for the ADA#1 nozzle is also seen to be significantly lower than the other nozzles. This is attributed to the larger discharge cross-sectional area of the ADA#1 nozzle, which should improve the effectiveness of the fine water mist in extinguishing fires in a confined space. For effective fire suppression in confined spaces the design objective is to have both the smaller droplets and lower momentum, so that the mist flows like a gas around obstacles to fill the available space, akin to a gaseous fire suppression agent. To achieve this objective, an even smaller droplet size distribution than that measured in these tests is preferred.

Figure 14:
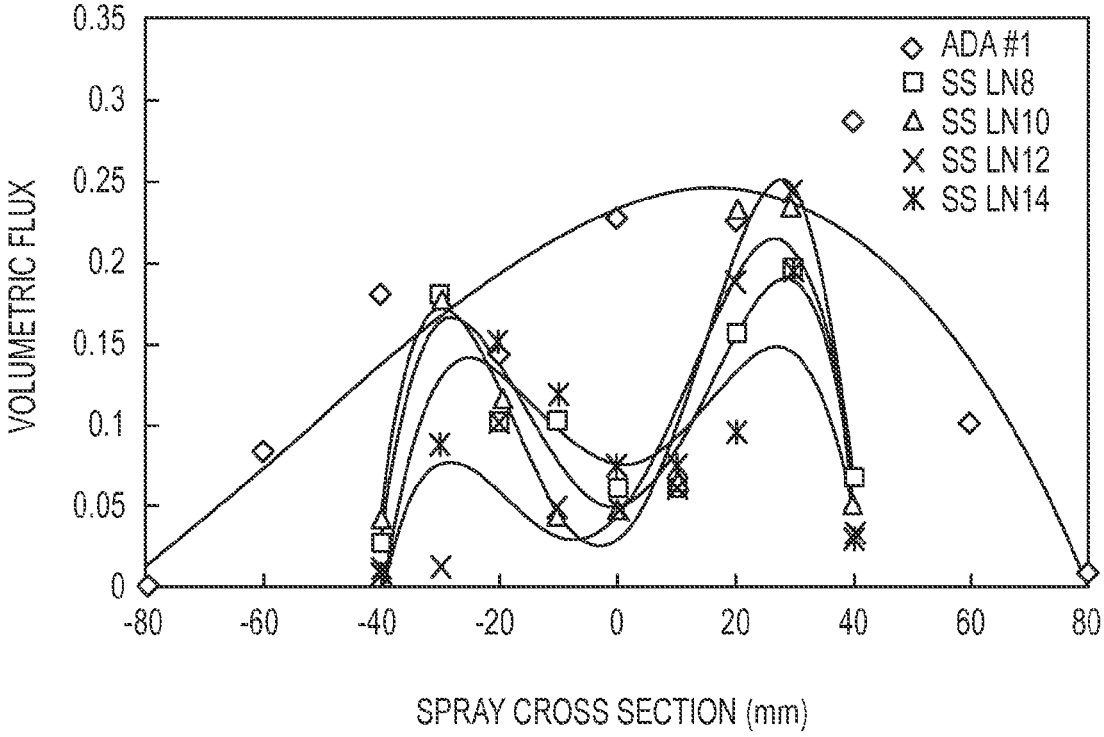
FIG. 14 is a plot of volumetric flux (vertical axis) against spray cross section (horizontal axis).

Volumetric flux in the nozzles is shown in the center graph of FIG. 14 as a function of measurement position along a horizontal axis. The ADA#1 nozzle spray pattern appears to be a full cone indicated by flux measurements that are relatively uniform through the central part of the cross section. In comparison the other nozzles have a hollow cone profile indicated by a substantial drop in flux through the center of the horizontal axis of measurement.

A number of variations and modifications of the invention can be used. It would be possible to provide for some features of the invention without providing others.

For example in one alternative embodiment, the bladder is not elastic but a non-elastic material that folds to foster uniform compaction of the contained volume inside the vessel during discharge. Such a material does not stretch when the system is full of water and thereby avoids the elastic stress which may tear an elastic bladder, particularly where significant acceleration and deceleration occurs.

In another alternative embodiment, the extinguisher can switch between three modes of operation. These modes are inactive, active low momentum and active high momentum. In the low momentum mode, the output droplet size ranges from about 10 to about 50 microns and velocity from about 10 to about 100 m/s. In the high momentum mode, the output droplet size ranges from about 30 to about 80 microns and velocity from about 30 to about 200 m/s. The low momentum mode, for example, can be used to extinguish fires in confined or small enclosed areas, while the high momentum mode can be used to extinguish fires in unconfined or large enclosed areas. The switch between the low and high momentum modes can be effected, for example, using a variable pressure control to control the fluid pressure in the extinguisher.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. The features of the embodiments of the invention may be combined in alternate embodiments other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations, combinations, and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method for suppressing an exothermic reaction, comprising:

(a) directing an outlet of a suppression device towards the exothermic reaction;

(b) opening a valve to permit a suppression liquid and carrier gas in a containment vessel to flow from a containment vessel, the liquid and carrier gas being located in the containment vessel and separated from one another by at least one of a movable and deformable separation member;

(c) after the liquid and carrier gas flow from the containment vessel, mixing the liquid and carrier gas to form a suppression fluid, the suppression fluid being in the form of droplets of the liquid dispersed in the carrier gas, wherein the mixing step comprises the substeps:

(C1) passing the liquid through a central passageway of an aspirating venturi;

(C2) passing the gas through at least one aspirating tube of the aspirating venturi to form the suppression fluid;

(C3) passing the suppression fluid through an aperture to accelerate the suppression fluid to a supersonic velocity;

(C4) expanding the gas to form droplets of the liquid entrained in the gas; and (C5) decelerating the droplets of liquid to below a sonic velocity to form an atomized suppression fluid comprising atomized droplets dispersed in the gas; and (d) discharging the atomized suppression fluid in a direction of the exothermic reaction.

2. The method of claim 1, wherein the exothermic reaction is at least one of a fire and deflagration, wherein the suppression liquid comprises water, and wherein the separation member is movably disposed in the vessel.

3. The method of claim 1, wherein the exothermic reaction is at least one of a fire and deflagration, wherein the suppression liquid comprises water, and wherein the separation member deforms in response to a pressure exerted by the gas in the containment vessel.

4. The method of claim 3, wherein a perforated flow pipe is positioned on a liquid-containing side of the separation member and wherein an aspirating venturi in fluid communication with the flow pipe effects mixing of the liquid and carrier gas.

5. The method of claim 4, wherein the liquid flows through a throat of the venturi and gas flows though one or more aspirating tubes of the venturi and wherein the gas flows through a valve prior to passing through the one or more aspirating tubes.

6. The method of claim 3, wherein the separation member is a membrane having a durometer ranging from about 75 Shore 00 to about 20 Shore 00 and wherein the separation member is substantially impermeable to the liquid.

7. The method of claim 3, wherein the separation member is a membrane having a durometer ranging from about 75 Shore 00 to about 20 Shore 00 and wherein the separation member is substantially impermeable to the liquid.

8. The method of claim 1, wherein the droplets have a Sauter Mean Diameter of no more than about 80, wherein the separation member is an elastomeric material having a durometer ranging from about 75 Shore 00 to about 20 Shore 00, and wherein the separation member is substantially impermeable to the liquid.

9. The method of claim 1, wherein the separation member is permeable to the gas but substantially impermeable to the liquid, thereby permitting part of the gas to dissolve in the liquid.

10. A suppression system, comprising:

(a) a containment vessel comprising a carrier gas and a suppression liquid;

(b) a separation member dividing the containment vessel into first and second portions, the first portion comprising the gas and the second portion the liquid, wherein the separation member is at least one of movably disposed in the containment vessel and shape changing in response to pressure exerted by the gas;

(c) a nozzle assembly to mix the liquid and gas, when removed from the containment vessel, disperse the liquid as droplets in the gas, and discharge a suppression fluid comprising the droplets entrained in the gas, wherein the nozzle assembly comprises an aspirating venturi in fluid communication with the gas and liquid, wherein the liquid flows through a central passage of the venturi, and wherein the gas flows through one or more aspirating tubes of the venturi and into the liquid; and (d) an actuator to initiate removal of the gas and liquid from the containment vessel.

11. The system of claim 10, wherein the separation member is movably disposed in the containment vessel.

12. The system of claim 10, wherein the separation member is shape changing in response to gas pressure.

13. The system of claim 12, further comprising a perforated flow pipe positioned on a liquid-containing side of the separation member, the flow pipe being in communication with the nozzle assembly.

14. The system of claim 10, wherein, prior to activation of the actuator, a check valve is closed to prevent the gas and liquid from passing through the venturi.

15. The system of claim 10, wherein the actuator comprises a handle, wherein movement of the handle displaces a release valve, the release valve comprising a plurality of ports in fluid communication with a conduit, and wherein the ports are displaced into fluid communication with a passageway comprising the liquid, thereby initiating flow of the liquid from the containment vessel.

16. The system of claim 10, wherein the separation member is permeable to the gas and substantially impermeable to the liquid.

17. The system of claim 10, wherein the separation member is a membrane having a durometer ranging from about 75 Shore 00 to about 20 Shore 00 and wherein the separation member is substantially impermeable to the liquid.

18. The system of claim 10, further comprising first and second conduits for removing the liquid and gas separately from the containment vessel and wherein the first and second conduits provide the liquid and gas to a mixing device.

19. A suppression system, comprising:

(a) a containment vessel comprising a carrier gas and a suppression liquid;

(b) a separation member dividing the containment vessel into first and second portions, the first portion comprising the gas and the second portion the liquid, wherein the separation member is at least one of movably disposed in the containment vessel and shape changing in response to pressure exerted by the gas;

(c) first and second conduits for removing the liquid and gas separately from the containment vessel;

(d) a nozzle assembly to mix the liquid and gas, when removed from the containment vessel, disperse the liquid as droplets in the gas, and discharge a suppression fluid comprising the droplets entrained in the gas, wherein the nozzle assembly comprises an aspirating venturi in fluid communication with the gas and liquid, wherein the liquid flows through a central passage of the venturi, and wherein the gas flows through one or more aspirating tubes of the venturi and into the liquid; and (e) an actuator to initiate removal of the gas and liquid from the containment vessel.

20. A method for suppressing an exothermic reaction, comprising:

(a) causing a suppression liquid and carrier gas to flow from a common containment vessel;

(b) as the liquid and carrier gas flow from the containment vessel, passing the liquid through a central passageway of an aspirating venturi and the gas through an aspirating tube of the aspirating venturi to form a first suppression fluid comprising the carrier gas bubbles dispersed in the liquid;

(c) thereafter passing the first suppression fluid through an aperture to accelerate the first suppression fluid to a supersonic velocity;

(d) expanding the gas to form a second suppression fluid, the second suppression fluid being in the form of droplets of the liquid dispersed in the carrier gas;

(e) decelerating the droplets of the liquid to below a sonic velocity to form a third suppression fluid comprising atomized droplets dispersed in the gas; and (f) discharging the third suppression fluid in a direction of the exothermic reaction.

21. The method of claim 20, wherein the liquid and carrier gas are stored at a common pressure in the containment vessel and wherein the exothermic reaction is at least one of a fire and deflagration, and wherein the suppression liquid comprises water, wherein a separation member, positioned between the liquid and carrier gas, deforms in response to pressure exerted by the gas in the containment vessel, wherein a perforated flow pipe is positioned on a liquid-containing side of the separation member, and wherein an aspirating venturi in fluid communication with the flow pipe effects mixing of the liquid and carrier gas.

22. A method for suppressing an exothermic reaction, comprising:

(a) directing an outlet of a suppression device towards the exothermic reaction;

(b) opening a valve to permit a suppression liquid and carrier gas in a containment vessel to flow from a containment vessel, the liquid and carrier gas being located in the containment vessel and separated from one another by at least one of a movable and deformable separation member;

(c) after the liquid and carrier gas flow from the containment vessel, mixing the liquid and carrier gas to form a suppression fluid, the suppression fluid being in the form of droplets of the liquid dispersed in the carrier gas; and (d) discharging the suppression fluid in a direction of the exothermic reaction, wherein the exothermic reaction is at least one of a fire and deflagration, wherein the suppression liquid comprises water, wherein the separation member deforms in response to pressure exerted by the gas in the containment vessel, wherein a perforated flow pipe is positioned on a liquid-containing side of the separation member, and wherein an aspirating venturi in fluid communication with the flow pipe effects mixing of the liquid and carrier gas.

23. The method of claim 22, wherein the liquid flows through a throat of the venturi and gas flows though one or more aspirating tubes of the venture, and wherein the gas flows through a valve prior to passing through the one or more aspirating tubes.

24. The method of claim 22, wherein the mixing step comprises the substeps:

(C1) passing the liquid through a central passageway of an aspirating venturi;

(C2) passing the gas through at least one aspirating tube of the aspirating venturi to form the suppression fluid;

(C3) passing the suppression fluid through an aperture to accelerate the suppression fluid to a supersonic velocity;

(C4) expanding the gas to form droplets of the liquid entrained in the gas; and (C5) decelerating the droplets of liquid to below a sonic velocity to form an atomized suppression fluid comprising atomized droplets dispersed in the gas.

25. A method, comprising:

(a) directing an outlet of a suppression device towards an exothermic reaction;

(b) opening a valve to permit a suppression liquid and carrier gas in a containment vessel to flow from a containment vessel, the liquid and carrier gas being located in the containment vessel and separated from one another by at least one of a movable and deformable separation member;

(c) after the liquid and carrier gas flow from the containment vessel, mixing the liquid and carrier gas to form a suppression fluid, the suppression fluid being in the form of droplets of the liquid dispersed in the carrier gas, wherein the mixing step comprises the substeps:

(C1) passing the liquid through a central passageway of an aspirating venturi;

(C2) passing the gas through at least one aspirating tube of the aspirating venturi to form the suppression fluid; and (C3) expanding the gas to form an atomized suppression fluid comprising atomized droplets of the liquid dispersed in the gas; and (d) discharging the atomized suppression fluid in a direction of the exothermic reaction.

26. The method of claim 25, wherein step (c) further comprises before step (C3) and after (C2):

passing the suppression fluid through an aperture to accelerate the suppression fluid to a supersonic velocity.

27. The method of claim 26, wherein the droplets of liquid decelerate below a sonic velocity during gas expansion.

28. The method of claim 25, wherein the exothermic reaction is at least one of a fire and deflagration, wherein the suppression liquid comprises water, and wherein the separation member is movably disposed in the vessel.

29. The method of claim 25, wherein the exothermic reaction is at least one of a fire and deflagration, wherein the suppression liquid comprises water, and wherein the separation member deforms in response to pressure exerted by the gas in the containment vessel.

30. The method of claim 29, wherein a perforated flow pipe is positioned on a liquid-containing side of the separation member and wherein an aspirating venturi in fluid communication with the flow pipe effects mixing of the liquid and carrier gas.

31. The method of claim 30, wherein the liquid flows through a throat of the venturi and gas flows though one or more aspirating tubes of the venturi and wherein the gas flows through a valve prior to passing through the one or more aspirating tubes.

32. The method of claim 25, wherein the droplets have a Sauter Mean Diameter of no more than about 80,wherein the separation member is an elastomeric material having a durometer ranging from about 75 Shore 00 to about 20 Shore 00, and wherein the separation member is substantially impermeable to the liquid.

33. The method of claim 25, wherein the separation member is permeable to the gas but substantially impermeable to the liquid, thereby permitting part of the gas to dissolve in the liquid.

34. A method, comprising:

(a) causing a suppression liquid and carrier gas to flow from a common containment vessel;

(b) as the liquid and carrier gas flow from the containment vessel, passing the liquid through a central passageway of an aspirating venturi and the gas through an aspirating tube of the aspirating venturi to form, by action of the liquid shearing the gas, a first suppression fluid comprising the carrier gas bubbles dispersed in the liquid, wherein the central passageway is oriented in a direction of flow of the first suppression fluid and the aspirating tube is oriented transverse to the central passageway, wherein a diameter of the central passageway of the aspirating venturi diverges to a relatively larger diameter at a downstream exit of the aspirating venturi;

(c) passing the first suppression fluid through an aperture to accelerate the first suppression fluid to a supersonic velocity;

(d) expanding the gas to form a second suppression fluid, the second suppression fluid being in the form of droplets of the liquid dispersed in the carrier gas; and (e) discharging the second suppression fluid in a direction of an exothermic reaction.

35. The method of claim 34, wherein the droplets decelerate below a sonic velocity to form atomized droplets dispersed in the gas.

36. A method, comprising:

(a) causing a suppression liquid and carrier gas to flow from a common containment vessel;

(b) as the liquid and carrier gas flow from the containment vessel, passing the liquid through a central passageway of an aspirating venturi and the gas through an aspirating tube of the aspirating venturi to form, by action of the liquid shearing the gas, a first suppression fluid comprising the carrier gas bubbles dispersed in the liquid, wherein the central passageway is oriented in a direction of flow of the first suppression fluid and the aspirating tube is oriented transverse to the central passageway, wherein a diameter of the central passageway of the aspirating venturi diverges to a relatively larger diameter at a downstream exit of the aspirating venturi;

(c) expanding the gas to form a second suppression fluid, the second suppression fluid being in the form of droplets of the liquid dispersed in the carrier gas; and (d) discharging the second suppression fluid in a direction of an exothermic reaction;

wherein the liquid and carrier gas are stored at a common pressure in the containment vessel and wherein the exothermic reaction is at least one of a fire and deflagration, and wherein the suppression liquid comprises water, wherein a separation member, positioned between the liquid and carrier gas, deforms in response to pressure exerted by the gas in the containment vessel, wherein a perforated flow pipe is positioned on a liquid-containing side of the separation member, and wherein an aspirating venturi in fluid communication with the flow pipe effects mixing of the liquid and carrier gas.

37. A suppression system for suppressing an exothermic reaction comprising:

(a) a containment vessel comprising a suppression liquid and a carrier gas, the containment vessel configured to allow the suppression liquid and the carrier gas to flow from the common containment vessel;

(b) an aspirating venturi comprising a central passageway and an aspirating tube, wherein the suppression liquid passes through the central passageway and the carrier gas passes through the aspirating tube to form a first suppression fluid comprising carrier gas bubbles dispersed in the suppression liquid;

(c) an aperture configured to receive the first suppression fluid and accelerate the first suppression fluid to a supersonic velocity; and (d) an expansion member wherein the carrier gas is expanded to form a second suppression fluid, the second suppression fluid being in the form of droplets of the suppression liquid dispersed in the carrier gas, wherein the droplets of the suppression liquid are decelerated to below a sonic velocity to form a third suppression fluid comprising atomized droplets dispersed in the carrier gas, wherein the third suppression fluid is discharged in a direction of the exothermic reaction.

* * * * *